US006820546B2

(12) United States Patent
Wynne

(10) Patent No.: US 6,820,546 B2
(45) Date of Patent: Nov. 23, 2004

(54) VERSATILE, ALIGNING STENCIL STRUCTURE

(76) Inventor: John H. Wynne, 8009 Bynum St., Long Beach, CA (US) 90808

( * ) Notice: Subject to any disclaimer, the term of this patent is extended or adjusted under 35 U.S.C. 154(b) by 12 days.

(21) Appl. No.: 10/080,470

(22) Filed: Feb. 22, 2002

(65) Prior Publication Data

US 2003/0159601 A1 Aug. 28, 2003

(51) Int. Cl.[7] ..... B41M 1/12
(52) U.S. Cl. ..... 101/129; 101/127.1; 101/128.21
(58) Field of Search ..... 101/114, 127, 101/127.1, 128.1, 128.21, 129; 434/84, 87; 33/562, 563, 565

(56) References Cited

U.S. PATENT DOCUMENTS

| | | | | | |
|---|---|---|---|---|---|
| 204,803 | A | | 6/1878 | Dana | |
| 2,040,988 | A | * | 5/1936 | Gragg | 101/127 |
| 2,421,825 | A | * | 6/1947 | Aulick | 101/127 |
| 2,438,828 | A | * | 3/1948 | Sims | 101/127 |
| 2,444,860 | A | * | 7/1948 | Summer | 101/115 |
| 2,451,775 | A | * | 10/1948 | Roher | 101/128 |
| 2,520,567 | A | * | 8/1950 | Schleif | 101/128 |
| 3,584,385 | A | * | 6/1971 | Booth | 33/564 |
| 3,624,944 | A | * | 12/1971 | Blomqvist | 40/618 |
| 3,665,889 | A | * | 5/1972 | Wagenvoord | 118/505 |
| 4,129,669 | A | * | 12/1978 | Lopez | 427/282 |
| 4,652,337 | A | | 3/1987 | Picone et al. | |
| 4,765,483 | A | | 8/1988 | Ernsberger | |
| 4,852,483 | A | | 8/1989 | Bussard | |
| 5,165,337 | A | * | 11/1992 | Schlundt | 101/114 |
| 6,142,071 | A | * | 11/2000 | Fexer | 101/128 |

* cited by examiner

*Primary Examiner*—Ren Yan
(74) *Attorney, Agent, or Firm*—William L. Chapin

(57) ABSTRACT

A stencil apparatus includes an elongated stencil support strip having at least one longitudinally extruding severance line, and at least one stencil support area between the severance line and the edge of the stencil support strip. Stencil elements with pressure sensitive adhesive on their lower surfaces are releasably mounted on the stencil support areas, arrangements are provided for permitting the removal of material underlying the stencil elements. The stencil apparatus may be formed of either one or two layers and have upper and lower support strips.

41 Claims, 10 Drawing Sheets

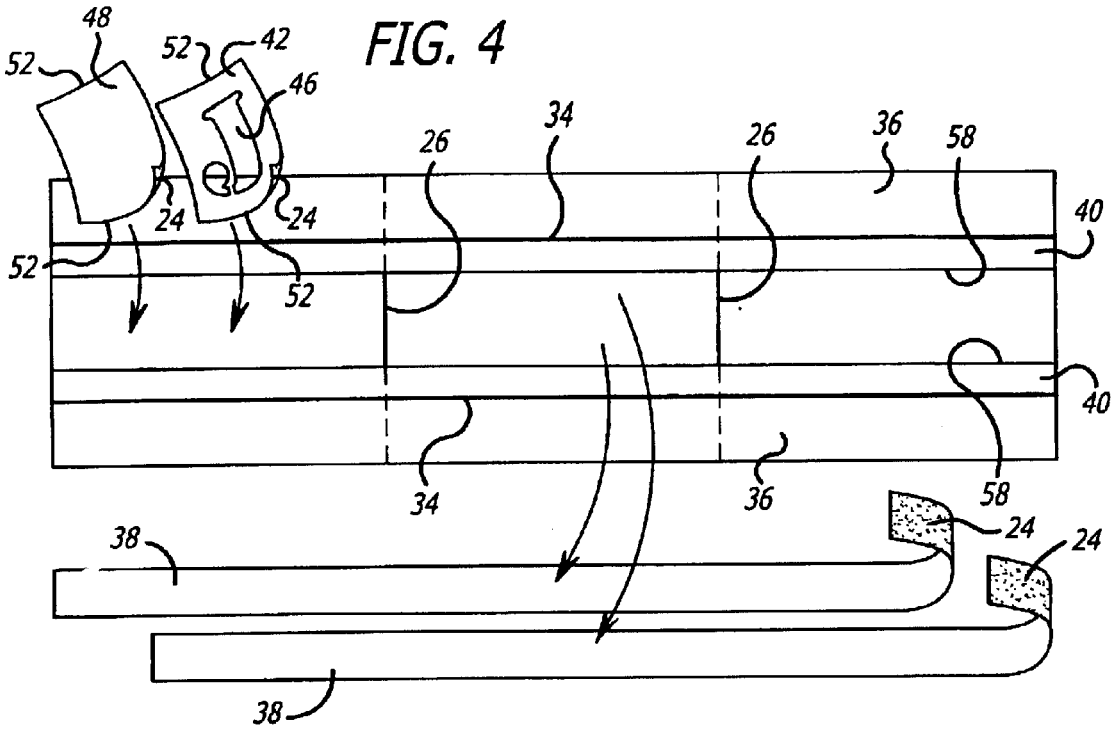
FIG. 4
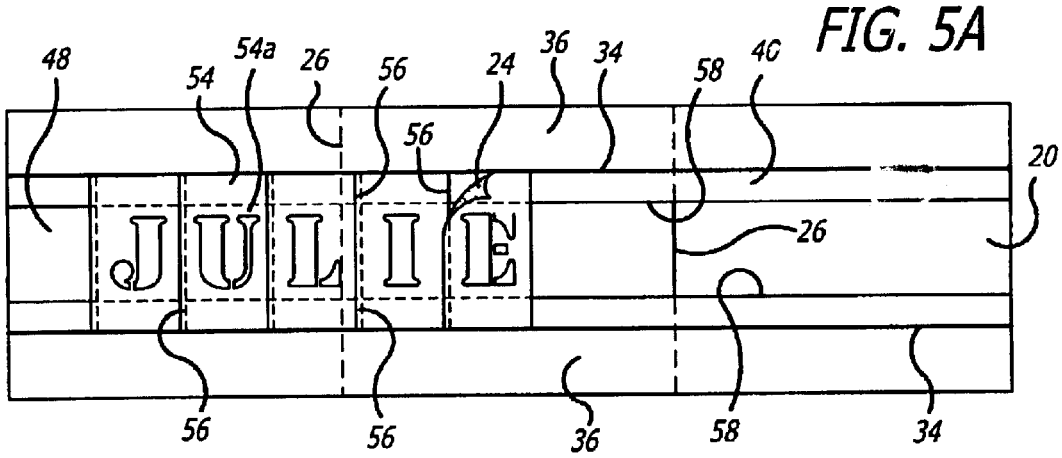
FIG. 5A
FIG. 5B
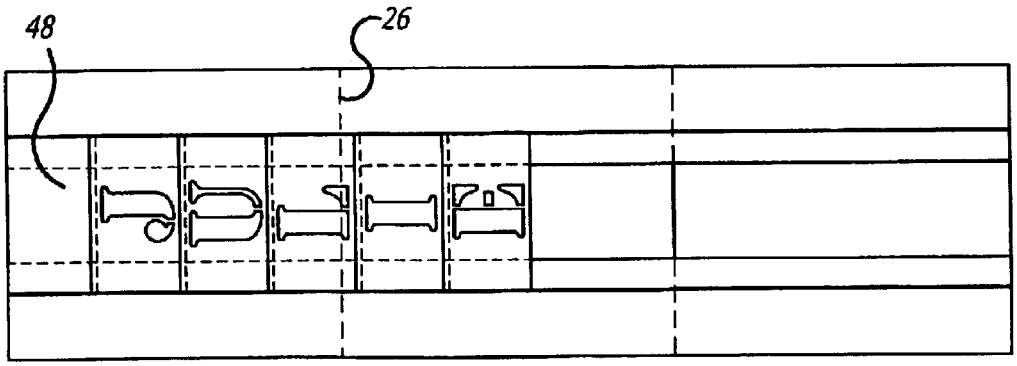

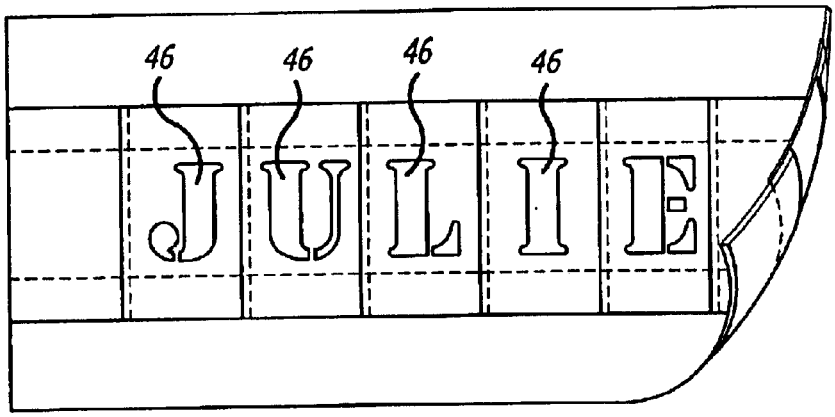
FIG. 8
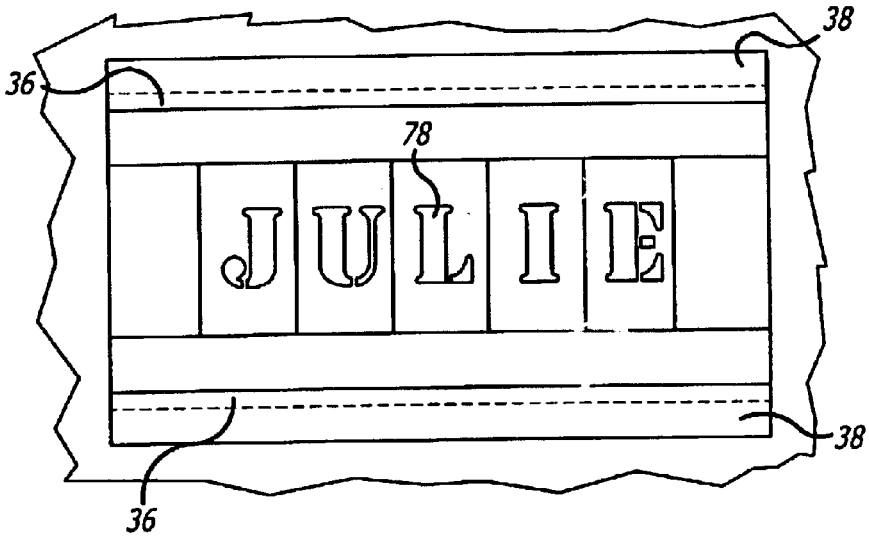
FIG. 9A
FIG. 9B
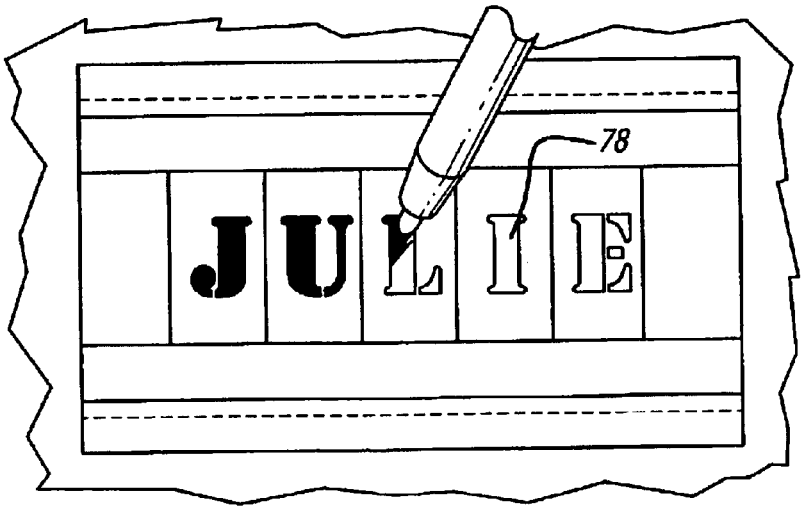

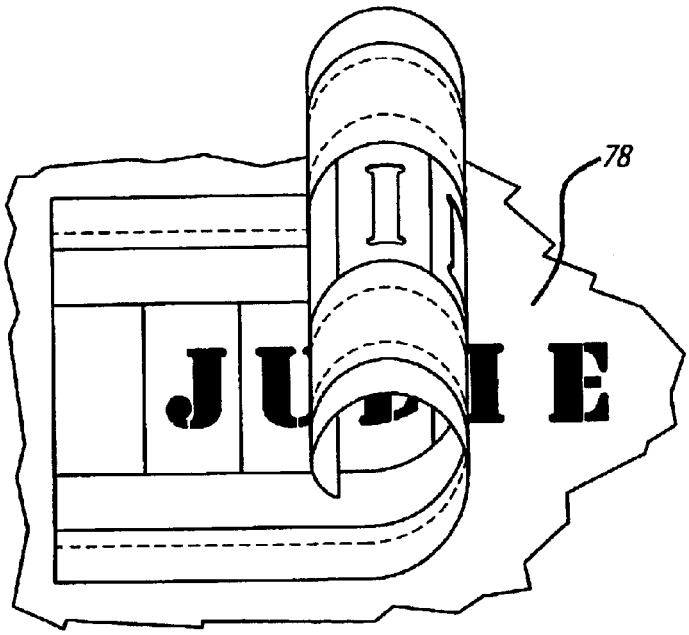
FIG. 10A
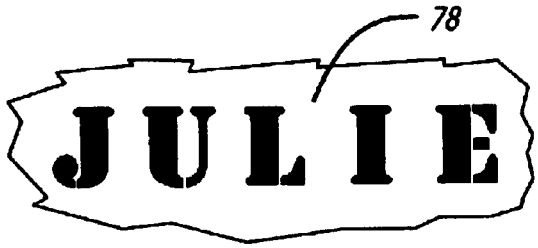
FIG. 10B
FIG. 11A
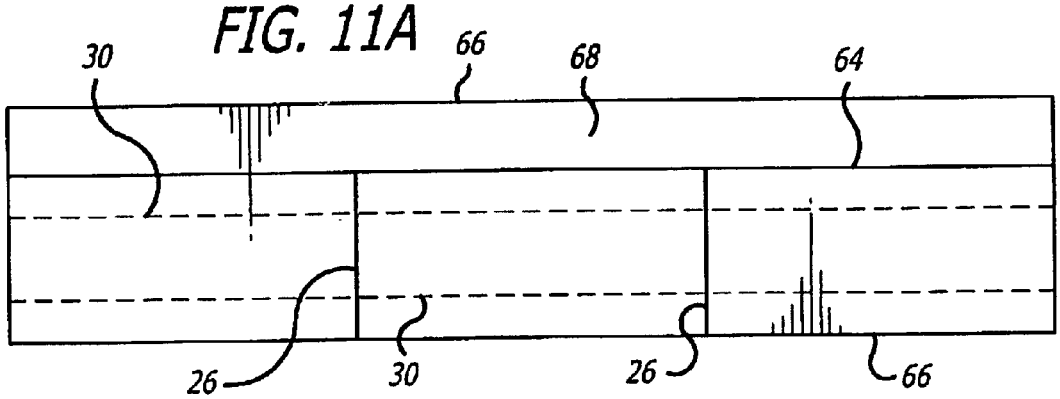

FIG. 15
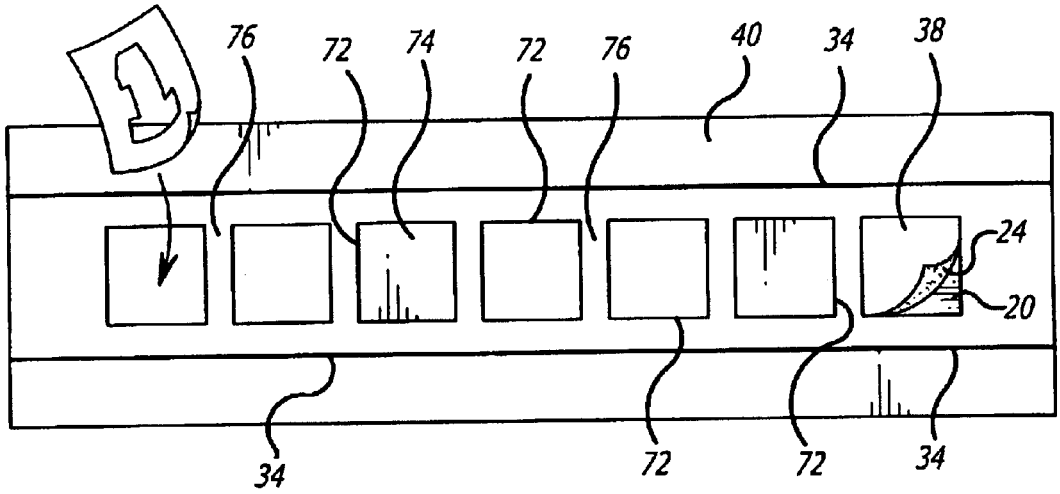
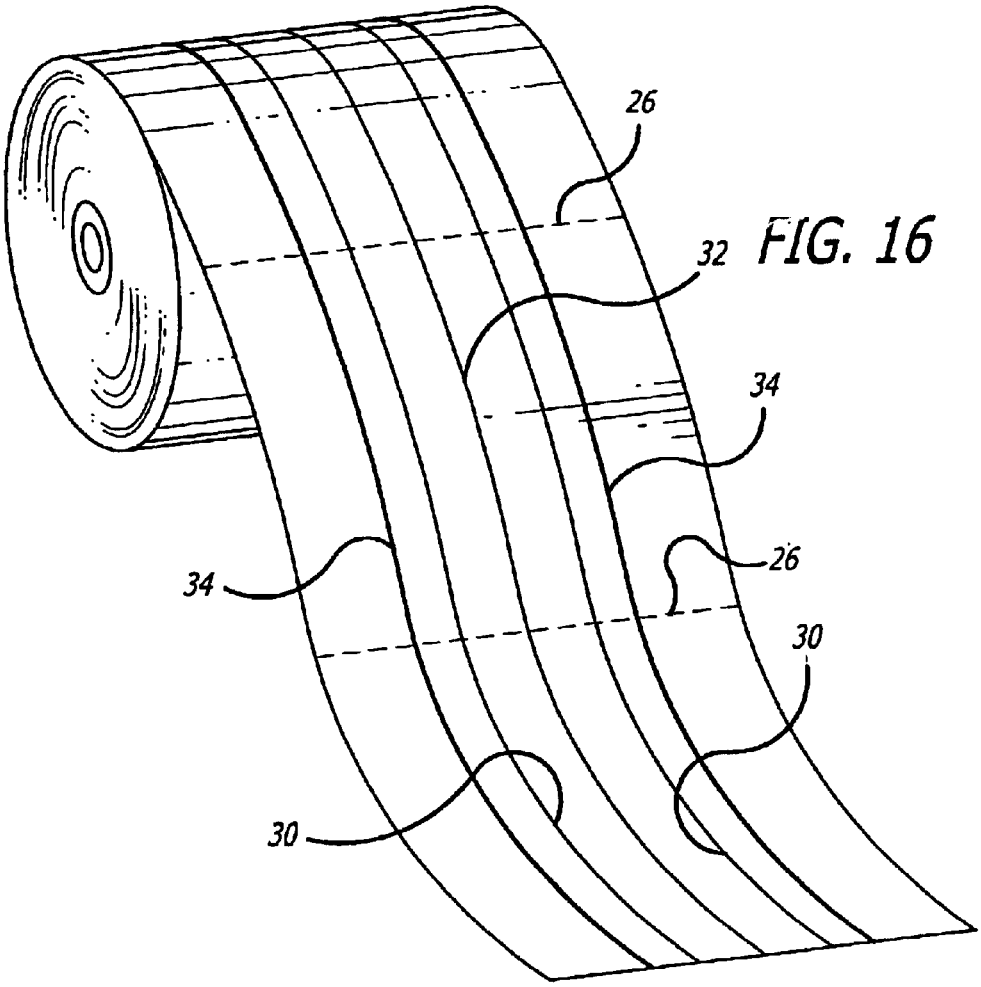
FIG. 16

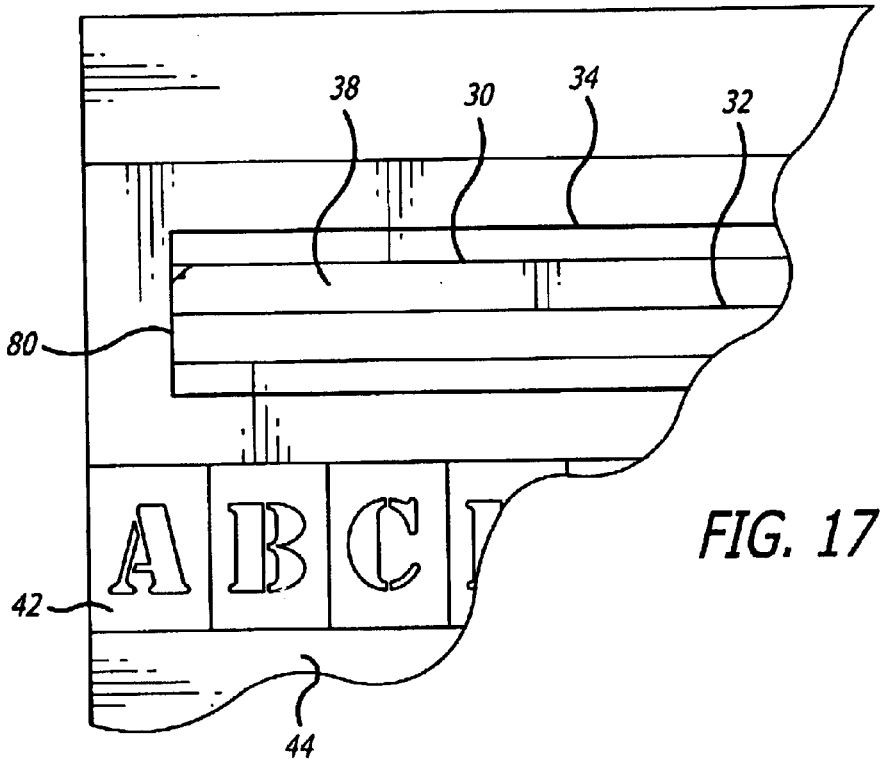
FIG. 17
FIG. 18
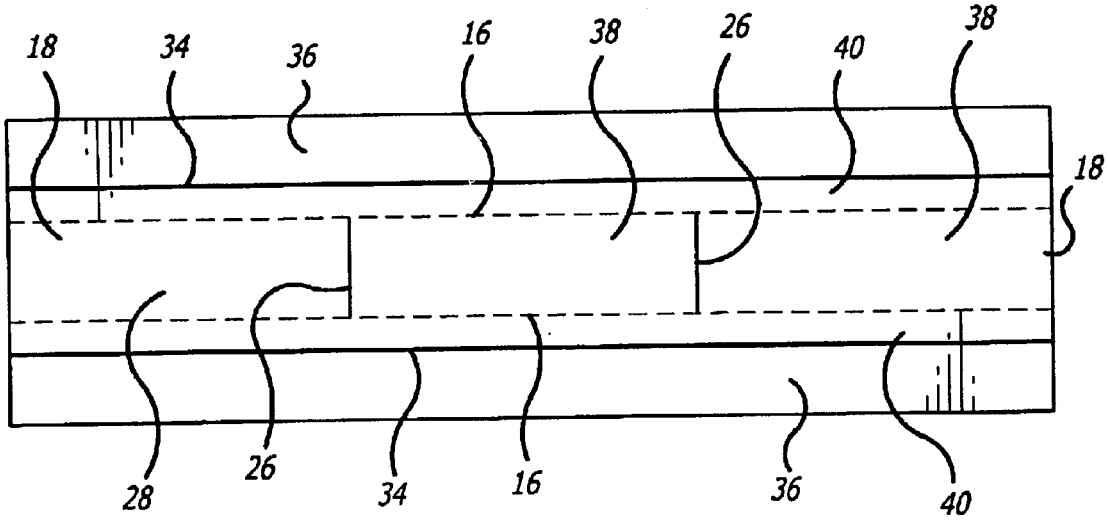

VERSATILE, ALIGNING STENCIL STRUCTURE

FIELD OF THE INVENTION

This invention relates to the field of personal identification, specifically to stencil holders used with adhesive backed stencils.

BACKGROUND DISCUSSION OF PRIOR ART

The desirability of permanent or indelible identification of one's possessions to prevent loss or theft has long been recognized. Those articles or property used in public places, shared with others or sometimes left unattended are highly vulnerable to loss and theft for obvious reasons. Certain industries, such as sporting goods, recreation, and travel, manufacture a large share of these items. Examples of the above include equipment such as bats, athletic gloves, balls, sport bags, and tents.

These articles represent a wide range of shapes, sizes, surfaces and substrates. This diversity, as or one can appreciate, requires a truly versatile marking system and presents a formidable challenge for the individual to identify his or her possessions in a permanent and satisfactory manner.

Various silkscreen systems, embroidery machines, and die cut hot stamp lettering devices are used commercially for marking or printing larger production runs of repetitive names, designs, etc. They are not readily accessible to the individual members of the public, and their application for personal identification would require custom lettering and machine set up which is time consuming and expensive. Their application is also restricted for use mainly to fabrics and generally for use on flat surfaces. Hot press letters have an additional disadvantage of not being durable.

In U.S. Pat. No. 4,852,483 J. W. Bussard shows a silkscreen kit for individual use, however, it has the same disadvantages of general silkscreening except on a smaller scale; requiring screen set up and clean up, technique mastery, and is limited to applications on fabrics and flat surfaces. In addition, the described stencil alignment frame is not designed for stencils with adhesive covering their entire backsides.

In U.S. Pat. No. 204,803 Charles Dana described thin stencils coated with a gum or adhesive on an adjoining edge so as to be linked together. This application cannot be adapted effectively using present-day aggressive, high tack adhesives covering the entire backsides of individual stencils. Overlapping such individual stencils causes them to adhere to each other, the target substrate or the working surface either too aggressively or in an unpredictable manner. Using stencils in this way makes repositioning and centering of the stencils difficult, if not impossible.

Presently, what is observed are attempts by individuals to identify their articles by the "freehand" application of felt tip markers, fabric paints, ballpoint pens, and the like. The results are often not permanent nor aesthetically pleasing and frequently result in the article's defacement. Furthermore, the results are certainly not compatible with the manufacturer's state-of-the-art lettering and design techniques, which are carefully crafted to enhance the products aesthetics and visibility. Indeed, the individuals' crude attempt to mark their possessions is usually starkly contrasted to the manufacturer's name and logo, which are artistically and often boldly and colorfully promoted.

Stencils with an adhesive backing and having cutouts or openings defining alphanumeric characters, symbols, or other designs have been used effectively to mark surfaces with sandblasting and chemical etching techniques as well as with paints and dyes. These stencils can be constructed from a wide variety of materials and coated with specialized adhesives. Using custom paints or dyes, applied with a variety of applicators, specific materials such as nylon, leather, metal and even rubbers can be coated. Distinct letters, marks, and other symbols are thereby formed.

Adhesive stencils are used in certain commercial applications where entire words or messages are preformed and cut into thin adhesive backed stencils. An example of this use is seen in U.S. Pat. No. 4,765,483 where E. R. Ernsberger describes a kit for using a precut adhesive stencil or mask for marking the surface of an automobile body.

These adhesive stencils which hold such a promise for personal identification are observed being used by individuals essentially for decorative purposes where symbols or sometimes letters or designs are used individually. This use has been seen in kits intended for decorative glass etching and also in kits for placing designs or symbols on such items as T-shirts or tennis shoes.

The lack of use of adhesive stencils for identification, the inventor believes, stems from the inherent difficulty of combining stencil letters into names or words necessary for this task, in order to accomplish this the stencils obviously need to be properly aligned and positioned with respect to one another and properly centered on the object. Some type of alignment and or transport device is needed to accomplish this, and herein lies the difficulty.

The thin characteristics and often fragile nature of the stencils combined with the frequent use of aggressive high tack pressure sensitive adhesives precludes the use of conventional stencil holders, frames, or other methods seen in the prior art. Absent such a device, alignment lines must be drawn on a wide variety of difficult to mark surfaces and the stencils have to be meticulously positioned, aligned, centered and perhaps overlapped with respect to one another directly on the target surface. This must be accomplished within the confines of the space available while avoiding preexisting lettering, stitching, etc. Surfaces, which are round or irregular in shape or have surface characteristics which require high strength adhesives pose particular challenges for positioning and repositioning.

Accurate initial placement of the stencils is, therefore, a critical step since repositioning and replacement of the stencils can be a delicate maneuver often resulting in the stencils tearing, wrinkling, sticking together, or sticking too tightly to some object. Even under the most careful of circumstances, mistakes in placement can be made that are difficult or impossible to correct.

The critical importance of accuracy in the initial placement of stencils on attractive surfaces is exemplified by the prior art of S. Picone and T. F. Picone in U.S. Pat. No. 4,652,337. A guide system is described whereby a first stencil with multiple openings and registration lines is initially located on a glass surface. A transport support panel also acting as a guide or "bomb sight" facilitates placement of very thin, non-adhesive backed, self-adhering individual stencils. The individual stencils, guided by the transport support panel, are placed in the opening of the first stencil where they contact a glass surface. This system has the serious drawback, mentioned above, of requiring one to work directly on the target surface and therefore requiring one to do it right the first time. Since this guide system is not forgiving of mistakes in stencil placement it would therefore seem to be more suitable for commercial use where experience is gained from repeated applications. In addition, this guide system utilized uniformly spaced fixed openings. Such a system, used for transferring automobile serial number indicia, does not allow for the variable spacing between letters of different widths necessary for forming the visually acceptable words or names for personal identification.

Accordingly, it would be beneficial if an inexpensive and easy to use adhesive stencil apparatus or device were to be developed to overcome the above disadvantages. Such a system should allow first time users. Including children, the ability to permanently mark their names, for example, on a wide variety of different objects in a neat and professional manner. The present invention provides the solution to this long existing problem.

SUMMARY OF THE INVENTION (A) Objects and Advantages

Several objects and advantages of the present invention are:

(a) to provide a novel, versatile, inexpensive, easy to use stencil apparatus or holder capable of accepting, supporting, and transporting adhesive stencils or stencil plates defining alphanumeric indicia or symbols.

(b) to provide a stencil apparatus or holder on which one can easily place, align, replace, or reposition individual adhesive stencil plates as often as necessary in order to achieve desired results.

(c) to provide a stencil apparatus or holder, as defined in the previous objects, which can accept individual adhesive stencil plates without the stencils or plates aggressively over adhering to each other, the stencil holder, or any other surface.

(d) to provide a stencil apparatus so that together with the attached adhesive stencil plates it can be positioned and repositioned on various surfaces and shapes without adhering to those surfaces, or adhering only lightly and temporarily.

(e) to provide a stencil assembly as defined in the previous object where one can preview or previsualize the apparatus with its individually placed stencil plates on the target surface and therefore facilitate centering, placement, and alignment by allowing repositioning of the apparatus and attached stencils as necessary enabling one to work around preexisting names, logos, stitching, and other obstacles.

(f) to provide a stencil apparatus or holder that can support thin stencils that are too flimsy for conventional stencil holders.

(g) to provide a stencil apparatus or holder that does not require critical accuracy in initial stencil placement, that is forgiving of mistakes and can be used without having to draw placement lines or making exact measurements.

(h) to provide a stenciling system where the individual stencils as well as the stencil apparatus can be positioned and repositioned as often as necessary so that errors in placement can be easily corrected.

(i) to provide a novel stenciling method for use in personal identification that is user friendly yet gives professional results without the individual being dependent on commercial applications.

(j) to provide a novel stencil set or kit for use in personal identification that includes: individual stencils; a stencil holder or apparatus; marking material such as ink or paint in a suitable container; an applicator tool such as a sponge, brush, etc; directions of use; a bag or other convenient packaging to contain all of the above.

SUMMARY OF THE INVENTION (B) Physical Embodiments

The above objects and other objects of the invention are accomplished by using a unique stenciling apparatus. Briefly, the apparatus comprises, generally, a bottom or backing sheet or removable release liner, which is adhesively but releasably attached to a top sheet of flexible planar material. The liner preferably, has release characteristics on its top surface which may be provided by a thin coating of silicone. One or more openings are provided in the top sheet thereby allowing the bottom liner to be exposed and forming the basic structure of the stencil apparatus or holder. The opening formed in the top sheet is preferably an elongated slot of substantially constant width. It is preferably rectangular in shape. The opening or openings can be prepared by a number of manufacturing methods readily apparent to those skilled in the art. They are made preferably, however, by extended cuts or other severance means through the attached top sheet and removing selected portions thereof. Alternatively, the openings can be pre-cut or pre-formed prior to the top sheet's adhesive attachment to the bottom liner.

Individual adhesive stencil plates bearing alphanumeric or other symbolic indicia in their central cutout areas and a pressure sensitive adhesive on one surface are provided. These stencils are then releasably affixed to and supported by a portion of the above stencil apparatus. Furthermore, the individual stencils are arranged in a linear array so that their central cutouts are contiguous with the exposed bottom liner of the stencil apparatus. An area of the individual stencils intermediate the stencil openings and their outside edges then contacts a portion of the top sheet. With the individual adhesive stencils so assembled and supported, the bottom liner can be separated from the top sheet, in whole or in part, thereby exposing the stencil's central openings. The assembly with stencil openings can then make adhesive contact with a surface, so that through said openings, a surface can be marked.

From another aspect of the invention, the stencil structure may include an elongated sheet of flexible planar material, which is capable of accepting and releasing individual adhesive stencils. The planar material, preferably has release characteristics on its top surface. One or more removable panels are provided in the planar sheeting forming the basic structure of the stencil apparatus or holder. The removable panels in the planar sheeting preferably, again, form an elongated slot of substantially constant width and are preferably rectangular in shape. The boundaries, dimensions, or outline of the removable panels are defined by cuts, perforations, lines of weakness or other severance regions applied to the planar sheeting. The severance regions are those known by those skilled in the art.

Individual adhesive stencil plates bearing alphanumeric or other symbolic indicia in their central cutout areas and a pressure sensitive adhesive on one surface are again provided. These stencils are again releasably affixed to and supported by a portion of the above stencil apparatus. The individual stencils are sequenced, as described earlier, in a linear array so that their central cutouts are contiguous with the removable panels of the stencil apparatus, while an area intermediate the stencil openings and their outside edges contacts a portion of the planar sheeting. The individual adhesive stencils so assembled and supported allow the removable panels to be separated from the planar sheeting along the lines of weakness or perforations. With the panels removed, the stencil's adhesive and central openings are thereby exposed and the assembly is applied to a surface. The surface can then be marked through the stencil openings.

The present invention further comprises a method of use, the components of which are preferably and conveniently assembled in a kit for individual application. The method specifically comprises the following steps: (a) arranging indicia forming adhesive backed stencils on the apparatus to form names or identifying symbols or the like; (b) providing pressure to the stencils to insure adhesive contact to the apparatus; (c) removing a removable panel or a portion of the underlying release type liner from the apparatus, thereby exposing the adhesive and indicia forming openings or central cutouts of the individually arranged stencils: (d) placing the apparatus and attached stencils on a desired surface or location to be marked; (e) applying pressure to insure temporary adhesive contact of the individual adhesive stencils to the selected surface; (f) applying ink, paint, etchant solution or some other marking means to the selected surface through the described stencil openings with a suitable applicator so that letters, or indicia defined by the stencil openings or cutouts can be reproduced; and (g) removing the apparatus from the surface.

From a broad aspect of the invention, a stencil apparatus includes an elongated stencil support strip having at least one longitudinally extending severance line, such as a perforation or a die cut, for examples, and at least one linearly extending stencil support area between the severance line and the edge of the stencil support strip. The stencil apparatus' also includes a number of individual stencil elements with adhesive on the lower surfaces thereof, sized and adapted for mounting or, the stencil support area. Further, the apparatus includes arrangements for permitting the removal of material underlying the stencil elements, except where the elements engage the support area, thereby exposing the adhesive coated lower surfaces of said stencil elements.

As discussed above, the apparatus may be formed either with one layer or two layers, and may have either one or two linearly extending stencil element support areas. The severance line or lines may be one or more die cuts in one case, or one or more perforations in another embodiment.

DRAWING FIGURES

In the drawings, the figures show various views, aspects, functions and preferred embodiments of the present invention. The numbers show separate parts and functions. Closely related figures have alphabetical suffixes. Other objects, features and advantages will become apparent from a consideration of the following detailed description and from the accompanying drawings.

BRIEF DESCRIPTION OF THE DRAWINGS

FIG. 4. illustrates a similar view of the stencil apparatus in FIG. 1. showing the selected top layers or panels completely removed and an adhesively coated stencil blank and stencil about to be placed on the apparatus;

FIG. 5A. is a view similar to FIG. 4. and showing the stencil blank and stencil in place along with additional stencils placed onto the assembly;

FIG. 5B is a view similar to FIG. 5A but showing how the stencils can be applied in a vertical manner;

FIG. 8. shows the stencil apparatus with the back release liner removed and the stencil openings exposed;

FIG. 9A. is a view of the stencil apparatus ready to be adhered to a selected surface with the previously removed top panels serving as additional masking elements.

FIG. 9B. shows a marking medium such as ink or paint being applied with an instrument to a surface through the stencil central openings or cutouts.

FIG. 10A. is a view of the stencil apparatus and attached stencils being peeled off the intended surface.

FIG. 10B. is a view of the completed stencil application with a surface marked with a person's name.

FIG. 11A. is a plan view from the rear where an elongated strip or section of back release liner can be formed from cuts extending through the liner.

FIG. 15. is a view of still another design of the invention showing a series of separate openings for the individual stencils.

FIG. 16. is a view showing one design of the present invention formed as a continuous strip or roll.

FIG. 17. is a plan view, partially broken away, of the stencil apparatus shown in FIG. 14. formed as part of a larger sheet.

FIG. 18. is a view of another embodiment of the stencil apparatus, showing how simply the apparatus can be made from a single sheet of material.

DETAILED DESCRIPTION OF THE PREFERRED EMBODIMENTS

Reference Numerals in Drawings

Figure 1:
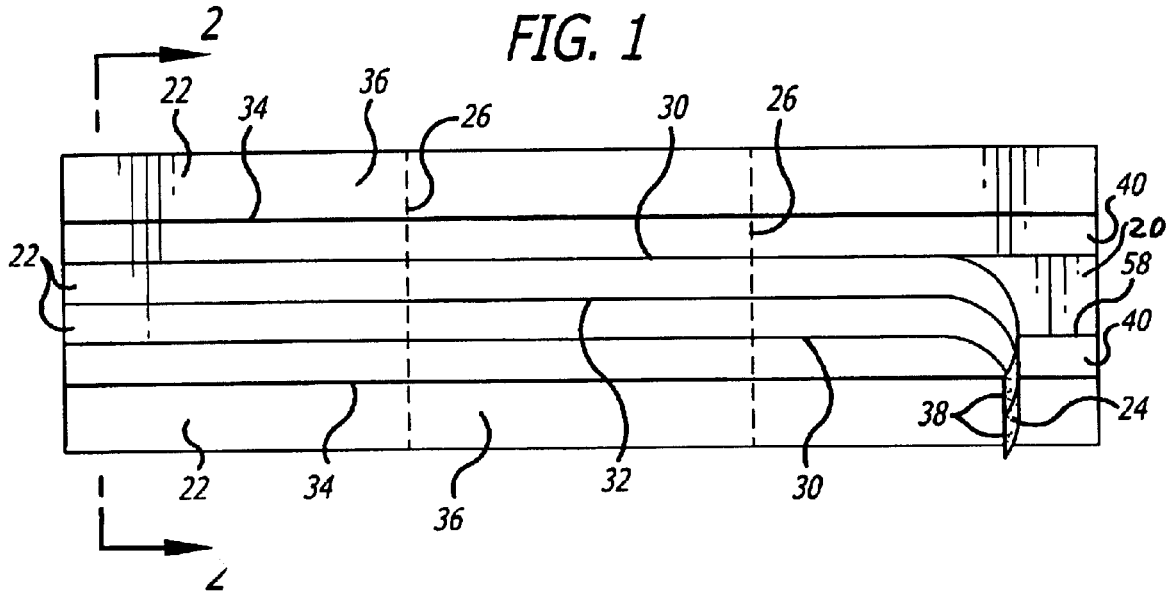
FIG. 1. is a view of a stencil apparatus with a portion of the top layer partly removed.

16 longitudinal perforations
18 planar material
20 release finer
22 top sheet
24 pressure sensitive adhesive
26 transverse die cut
28 surface release characteristics
30 offset longitudinal die cut
32 central longitudinal die cut
34 alignment line
36 masking section
38 panel
40 stencil attachment member
42 individual stencil
44 planar sheeting
46 central cutout
48 spacers
50 knock out
52 stencil edge
54 extended area
54*a* remaining extended area
56 stencil overlap
58 opening edge
60 alignment marks
62 vertical cut
64 back die cut
66 outside edge
68 elongated strip
70 closed end
72 additional die cut
74 opening
76 additional support area
78 surface
80 end cut

Description—FIGS. 1 to 5

Figure 2:
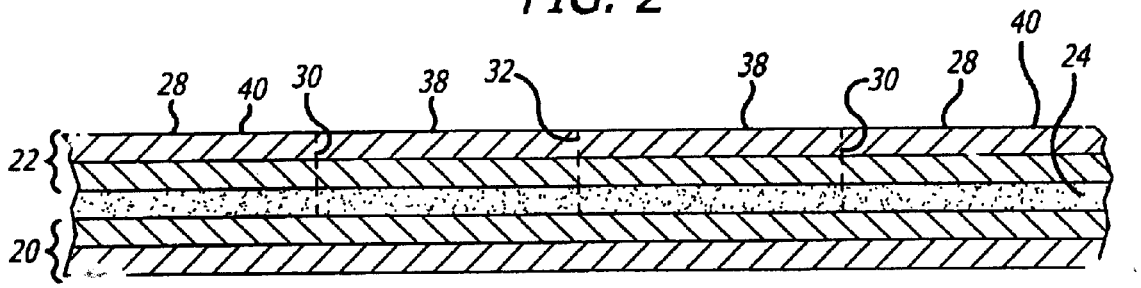
FIG. 2. is an enlarged cross-sectional view taken on line 2—2 of FIG. 1.

A typical embodiment of an apparatus illustrating the principles of the present invention is illustrated in FIG. 1 with two removable panels 38 partially peeled back. FIG. 2 is an enlarged cross sectional view taken on line 2—2 of FIG. 1. The apparatus has a bottom sheet of release liner 20. A layer of flexible planar material forming a top sheet 22 is adhesively and releasably adhered to the release liner 20 by means of a pressure sensitive adhesive 24. The top sheet 22 has release characteristics 28 on the upper or exposed surface. In this regard, it may be noted that release characteristics may be provided by applying a thin coating of silicone to the surface of the paper layers offset longitudinal die cuts 30 and a central longitudinal die cut 32 are made completely through the top sheet 22 and pressure sensitive adhesive 24 and run parallel to each other and across the width of the apparatus. These die cuts form the panels 38 in the top sheet. The longitudinal die cuts 30 also define the boundary of the stencil holder or stencil attachment members 40. Stencil placement guidelines or alignment lines 34 (see FIG. 1) are located on the surface of the apparatus and bisect each stencil attachment member 40 as it extends along its length. The area between the alignment lines 34 and the outside edges of the stencil apparatus serves as an additional and optional masking section 36. One or more transverse die cuts 26 extending through the release liner 20 provide means for easily stripping away the liner 20.

The panels 38 can be removed by slightly bending the apparatus towards one end along one of the die cuts and peeling the panels up and off with one's fingers. FIG. 1 shows the two panels partially removed and separated from the apparatus at one end while also exposing a portion of the underlying release liner 20.

The area of the exposed release liner is designed to be of sufficient width to accept, i.e., to provide unobstructed access to, the central cutout portion 46 of the individual stencils 42 and may therefore be referred to as an access area. FIG. 4 shows the stencil apparatus with the two panels 38 completely removed and set aside to be used optionally for additional masking. Alternately, the apparatus can be provided without these panels or with the panels removed and the release liner (20) exposed in the manufacturing process if they are not intended to be used for masking purposes. In another variation a single wider panel can be formed and then removed by the user. The central panel material can even be cut into additional blanks or individual stencils if desired.

Pressure sensitive adhesives suitable for use in the present invention are those known in the art which are compatible with the selected release liner as well as those materials chosen for the top sheet. The adhesive should also provide sufficient adhesion to enable the top sheet 22 and release liner 20 to be held together while also allowing their eventual separation. Various rubber based pressure sensitive adhesives as well as acrylic and emulsion acrylic based pressure sensitive adhesives can be used successfully provided that they are compatible with the chosen liner and top sheet.

Release liners chosen for use in the present invention may also be those known in the art. They should be selected for their release characteristics relative to the chosen pressure sensitive adhesive. Calendered paper with a thin coating of silicone may be employed, for example.

The adhesive attachment of the top sheet 22 to the release liner provides a structural support and stability to the thin and flexible top sheet. This support, as the reader shall see later in the various ramifications of the invention, allows a surprising versatility in forming a wide variety of shapes and configurations of stencil holders heretofore unavailable. The top sheet can, for example, be cut or otherwise formed as shown in the preferred embodiment in FIGS. 1, 2 and 4 as described above so that the stencil apparatus is open or unsupported at the ends without loss of functionality. This construction obviates the need for conventional stencil frames that are closed at the ends. Furthermore, this structure made possible by the novel construction enables the stencil apparatus to be cut or torn to any suitable length, without loss of functionality, thereby allowing it to conform to the size dictated by the number of individual stencils needed in a particular application. The structure also allows the cut portion or remnant to also be used if needed.

Although release liners, known to those skilled in the art, are used for the bottom sheet to accept and release adhesive stencils, the upper surface characteristics of the top sheet, however, can vary considerably depending on a number of factors. The top sheet, for example, can be constructed with surface characteristics similar or identical to actual release liners. These characteristics or properties, however, are not always required nor desired and often are counter productive since some adhesion of the stencils to the top sheet is necessary, providing structural support or reinforcement to the stencil apparatus or holder. This added structural support provided by the adhered stencils enables the bottom liner to be later removed. In addition, the actual surface area of the stencil attachment member 40 formed from, the top sheet, which contacts the adhesive stencils, can be made to be comparatively small. This decreases the surface area in contact with the adhesive, a factor in decreasing the individual stencil's relative adhesive strength, pull, or attraction to the stencil attachment member while also increasing their relative releasability. Furthermore, the relative brief contact with the stencil attachment member by the stencil's adhesive also prevents increased adhesion of the stencil's adhesive by decreasing the adhesive contact time thereby allowing for more releasability. Finally the actual stencil's adhesive, the strength of which is generally determined by the requirements of the surface to be marked, can be of moderate tack or lower adhesive strength and not require a surface designed specifically for its release properties.

From the above discussion one can appreciate that there are many commonly used materials and surfaces, which were not specifically designed for their release characteristics, but can function as the top sheet and stencil attachment member due to a number of factors, including their inherent release properties. There are a number of advantages in having a large selection of common materials available for use. For example, readily available materials such as calendared lithography paper or other types of paper can be used effectively with stencils bearing a weaker type removable adhesive. This paper is not only relatively inexpensive, but its top surface, unlike common release paper, can-easily accept printing so directions, designs, logos, graphics, alignment lines, or other information can be provided. Specialized surface coatings, which provide a release surface for use on paper and films to make printable tapes can also be utilized in this manner. Where more aggressive stencil adhesives are used, a surface similar to that of standard release liners and coated with silicone or some other release material can be used. It has been found that certain materials such as polyolefins, used to make products such as Tyvek®, have surface characteristics with natural release-like properties that can be used effectively as a top sheet forming the stencil attachment member in the present invention. Tyvek® is primarily designed to be tear resistant which can be an additional advantage in applications requiring very aggressive adhesives that could cause the stencil apparatus or individual stencils to tear upon removal or replacement. Tyvek® is a product of Dupont Company of Willmington, Del.

Acucote, Inc. of Charlotte, N.C. supplied the materials used in the preferred embodiment for both the stencils and the apparatus. The material is Tyvek® and is coated with an adhesive labeled AC 20P. It is adhered to their 50# T liner.

Regardless of what surface characteristics are chosen for the top sheet and stencil attachment member, the end result is that it works together with the release liner to form a dual surface which supports the individual stencils and allows them to be sequentially placed on the apparatus while also allowing them to be easily removed and repositioned on said apparatus as often as necessary in order to achieve proper alignment.

Various combinations of colors and shading as well as printed information can be employed in the construction of the stencil apparatus, the separate components, or the individual stencils for aesthetic purposes or to help clarify directions or for some other purpose. The colors can be inherent in the various construction materials used in making the apparatus or they can be added in a separate process such as in printing. Similarly, clear or translucent sheeting materials can also be employed.

Figure 3:
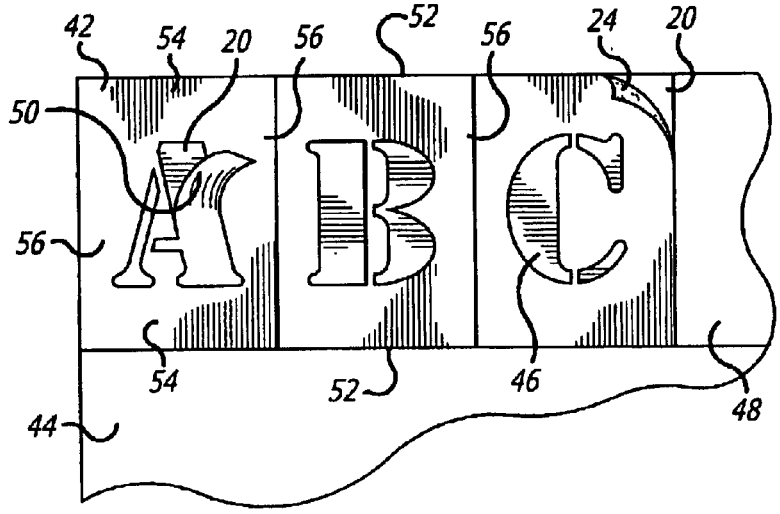
FIG. 3. is a fragmentary view of a plurality of individual adhesive backed stencils located on a sheet of release finer.

Referring now to FIG. 3 (plan view) and FIG. 4 a plurality of individual adhesive backed stencils 42 are die cut or otherwise formed conveniently from a planar sheeting material 44, usually thin paperboard, film, plastic, thin metal or other suitable material. The stencil forming sheeting material is preferably impervious to any selected ink, dye, or other liquid medium contemplated for use in this invention. The sheeting 44 prior to being die cut is first coated with a pressure sensitive adhesive 24 and is attached to a protective release liner 20. The release liner chosen for use here may be selected from any number of release liners as long as it is compatible with the pressure sensitive adhesive used on the individual stencils. Each stencil is generally rectangular in shape and has a central cut out 46 intermediate the edges of each stencil and defining an alphabetical character, a numeral, a symbol, or other imagery. The stencils forming alphabetical characters should be formed or cut from the planar sheeting in widths that correspond to the width of the stencil letters. The stencil forming the letter "I", for example, would be smaller in overall width than the stencil "W". This would provide the appropriate uniform spacing to the letters that is visually pleasing. Along this line, the stencils could also be made so that their side edges could be easily modified to "nest" with adjoining stencils. Blanks or rectangular spacers 48 are also formed in the above-described sheeting 44 by having no central cut out. A knock out 50 is shown in FIG. 3 being partially removed to expose the underlying release liner 20 while forming the alphanumeric character or central cut out 46. An individual stencil 42 is shown being partially removed at its upper corner from sheet 44. Each stencil, furthermore, is of uniform height and has an extended area 54 also of uniform height that extends from the central cut out 46 to the upper and lower edge of the stencil. The outer portion of this extended area on the stencil is for the stencil's contact with the stencil attachment member 40 of the stencil apparatus (see FIGS. 1 and 4).

In FIG. 5A one can see how the stencils are placed in relationship to the stencil apparatus and the adjacent stencils. Here one can see how the outside portion of this extended area 54 is for attachment to the stencil attachment section of the stencil apparatus as described above. The remaining or inside part of this extended area 54*a* generally falls within the area of the exposed release liner and provides a margin of error in stencil placement while also receiving additional support by its attachment to the release liner. Each stencil should additionally have a stencil overlap area 56 along both lateral edges of equal spacing so that stencils can be overlapped slightly a uniform amount, if so desired. This stencil overlap area provides a margin for error so that the stencil's lateral edges do not encroach upon the central cutout area of adjacent stencils. The overlap area also prevents the seepage of liquid dyes, paints or other colorants between stencils. The stencils can be seen in relationship to the stencil apparatus and the above-described areas in FIG. 5A. FIG. 5B shows a variation of the assembled stencils using central cut outs which have been rotated ninety degrees for a vertical effect. This is a variation that can be used with any other ramification of the invention.

Although these individual stencils are shown here, for sake of convenience, arranged in sheet form it should be understood that this arrangement is not central to this invention and they could be assembled together in some other configuration. For example, they could be put together in pad or roll form and peeled off as needed or individually cut and provided separately. The individual stencils described above are preferably designed and constructed to be used with the described stencil apparatus. They could conveniently be supplied with the stencil apparatus together with a means for tracing or reproducing alphanumeric or other characters on a receiving surface thus completing the kit of the invention. Various types of inks, dyes, paints, etc. used to mark a surface can be supplied in the kit, as well as applicators such as brushes, sponges, rollers, or the like. The surface to be marked generally determines the means and materials to be used in the stenciling process.

Operation—FIGS. 1 to 11C

Referring now to FIGS. 1 to 11C, the operation of the above typical embodiment will be described. In the example provided, an individual's name will be formed on the stencil apparatus using the stencils and the name will be reproduced on the surface of a substrate.

In FIG. 1 the panels 38 are first individually removed by bending an edge of the panel at one end along a die cut and lifting it and peeling it up and entirely off the apparatus. Since the panels have a pressure sensitive adhesive 24 on their back side and can be used later as masking, they can be set aside by lightly but removably attaching them to a convenient surface such as a table top or desk as seen if FIG. 4. Care should be taken to prevent the individual panels from inadvertently sticking together or attaching too strongly to any surface.

The stencil blank or spacer 48 is next removed from the stencil bank or sheeting 44 as illustrated in FIG. 3. The spacer with the pressure sensitive adhesive 24 exposed on the underside is then positioned, as seen in FIGS. 4 and 5A, so that a side edge of the spacer is aligned with the extreme left edge of the stencil apparatus. The upper and lower edges 52 of the stencil blank are simultaneously aligned with the respective upper and lower alignment lines 34 located on the surface of the stencil apparatus. Once the blank is in proper position, light finger pressure is applied to the blank's surface to provide sufficient adhesion of the stencil blank to the stencil apparatus. The stencil then makes simultaneous contact with the release liner 20 and the stencil attachment members 36. In similar fashion an individual stencil 42 is selected and placed on the stencil apparatus aided by the previously described alignment lines, as shown in process again in FIG. 4. The side edge of the stencil closest to the blank is either abutted to the edge of the blank or slightly overlapped as described earlier and as shown in the example in FIG. 5A. In like fashion additional stencils are selected to continue to spell out a name or other desired word or symbol. They are aligned, and placed as shown in FIGS. 4. and 5A. where the stencils and blank are shown slightly overlapping 56 one another a uniform amount. The overlapping gives an automatic equal spacing between letters or numerals and also prevents seepage of inks, dyes or other liquid colorants used in the stenciling application. With the stencils so aligned the central cutouts 46 make contact with the exposed release surface 20.

The opening formed by the exposed release surface is taller in height than the vertical dimension of the stencil cutouts 46 thereby allowing the stencil cutouts to be completely clear of the opening edges 58 formed by the lateral die cuts 30. The extended area 54 above and below the central cutouts provides a contact area where the pressure sensitive adhesive of the stencils can contact the stencil attachment member 40 while also allowing for maneuverability and providing a margin for placement error. This contact or overlap between the stencils and the attachment member also provides an additional seal to further prevent seepage of inks, dyes, or paints as mentioned above.

One can see then by the above description and drawings that the stencils are supported by and adhesively attached to both the stencil attachment member and the exposed release liner.

The individual stencils 42 can be placed on the apparatus and removed easily if errors of placement or alignment are made. This is one of the features of this stencil apparatus and is made possible by the release liner 20 combined with the surface release properties of the stencil attachment member 42 formed from the top sheet. In order to provide this capability the adhesive attachment of the top sheet to the release liner, described above, should be of sufficient strength and releasability to hold the unit securely together yet also allow its eventual separation. In addition, the attractive and repelling forces of the release liner and the pressure sensitive adhesive so described should work cooperatively or synergistically with the upper surface characteristics of the top sheet or stencil attachment member. The combined or correlated action of those forces and materials, should allow the adhesive stencils to be placed and held on the stencil apparatus yet easily removed without the stencils dislodging the stencil attachment member from the release liner or otherwise causing inadvertent separation of the apparatus.

In actual construction and selection of materials for the stenciling apparatus, a recommended starting point would be to first determine the surface characteristics of the target surface, since the surface properties of the substrate determine the strength or type of adhesive required for use on the individual stencils. The adhesive chosen for the stencils should be of sufficient strength to be able to temporarily hold the stencils securely but releasably in contact with the target surface and be able to form an adequate seal around the edges of the stencil cutouts. The adhesion and seal should allow inks, paints, dyes, etc. to be applied through the stencil's central openings without the stencils being dislodged. Once the optimum adhesive strength is chosen for the individual stencils, the bottom release liner, top sheet, and their combining adhesive can be selected for their cooperative actions.

Pressure sensitive adhesives used on the individual stencils that are suitable for use in the present invention are those known in the art which are compatible with the selected release liner as well as the materials and surface characteristics chosen for the sheeting material. In addition, the adhesive should be selected so that it provides sufficient adhesion of the individual stencils to the planar sheeting as well as providing ultimate release from the substrate or target surface to be marked. The adhesive should also provide sufficient adhesion to enable the stencil apparatus to be held together, once the release liner is separated from the apparatus. Various rubber based pressure sensitive adhesives as well as acrylic and emulsion acrylic based pressure sensitive adhesives can be used successfully provided that they are compatible with the chosen liner and planar sheeting.

As one skilled in the art can appreciate, there are many choices or possibilities regarding the combinations of liners, adhesives, and top surfaces available for use. Some initial evaluation of materials is usually necessary, therefore, to arrive at an ideal combination and balance of materials in order to get the desired results. In actual practice, it has been found that it is usually a simple matter of: selecting a bottom sheet of release liner and an adhesive with enough adhesive strength; so that together with the surface characteristics of the top sheet, the adhesive stencils can be placed on the formed apparatus and removed easily. The stencils must, however, be able to be removed without their causing separation of the laminated assembly or stencil apparatus. Generally, the stronger the adhesive required by the individual stencils the greater the adhesive required between the bottom liner and top sheet and the more release factor or release capabilities needed on the surface of the top sheet.

The unique structure of the invention enables it to be constructed using a variety of manufacturing methods. Although a die cut process is presented as one means for forming the apparatus and stencils, therefrom methods and electrostatic processes and other suitable manufacturing methods known by those skilled in the art are available and can be used to make the invention.

Figure 6A:
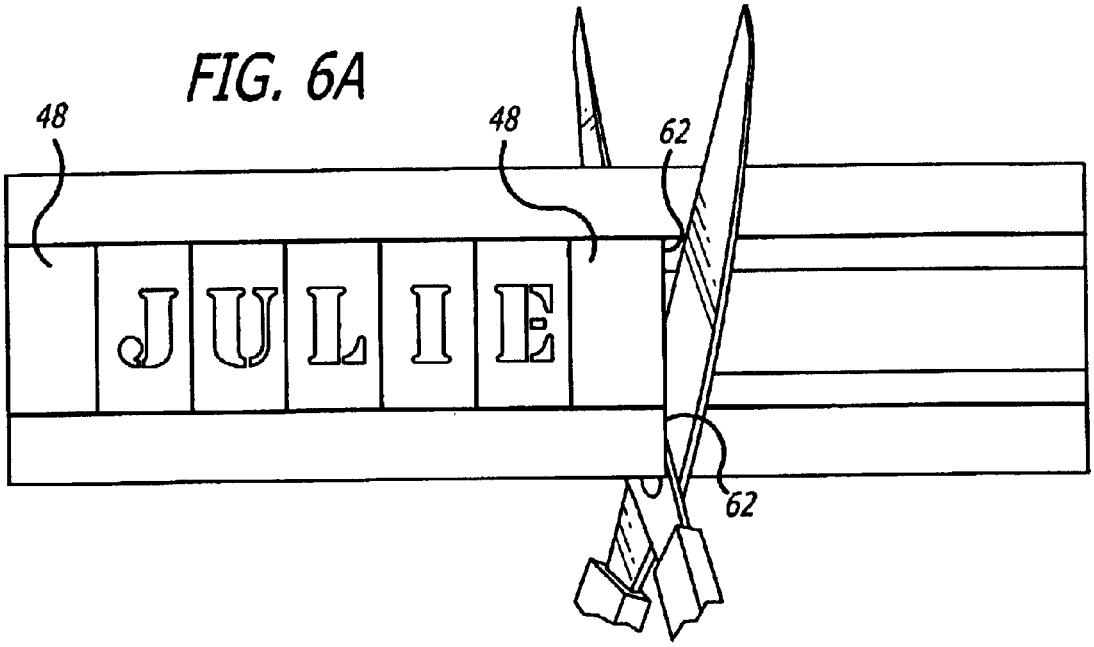
FIG. 6A. is a view similar to FIG. 5A and showing the stencil apparatus with the individual stencils in place on the apparatus and the apparatus about to be cut.

Referring now to FIG. 6A there is illustrated the stencil apparatus with all the stencils in place including a spacer 48 placed in similar manner as the other stencils but at the right end of the assembled stencils. The spacer slightly overlaps the previously placed stencil in a manner described earlier and shown here in FIG. 6A. The spacers 48 serve primarily as additional masking, preventing accidental or inadvertent marking of adjacent stencils by liquid ink, paint or other mediums. The spacers can also serve as space holders between individual stencils to separate words such as first and last names.

Figure 6B:
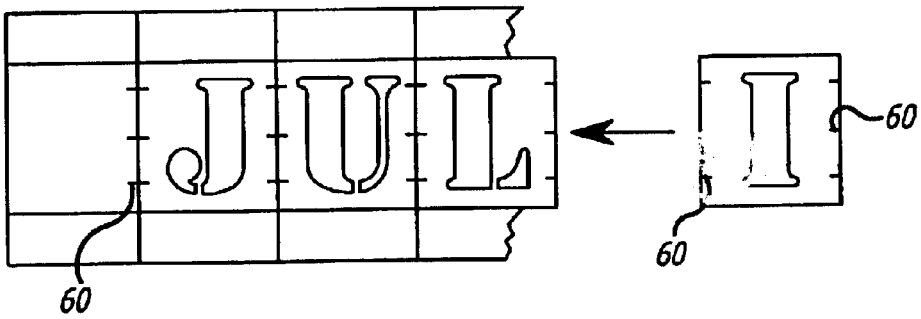
FIG. 6B. is a fragmentary view showing individual stencil placement with the aid of alignment marks on the individual stencils.

FIG. 6B is a fragmentary view showing individual stencils placed with the aid of additional but optional printed calibration or alignment marks 60 located on the surface of the individual stencils. Here the stencils are aligned with the alignment lines 34 described earlier but also aligned with the aid of adjacent marks placed on the individual stencils.

Once the individual stencils are placed and the last spacer is in position the stencil apparatus may be shortened as shown in FIG. 6A. This is a feature of the invention made possible by the unique construction of the apparatus, which was discussed earlier. A vertical cut or separation 62 is made completely through the apparatus along the line formed by the vertical edge of the last spacer. The vertical cut 62 which completely severs the apparatus, as shown here made with scissors, can also be accomplished by other cutting means or even by tearing with one's fingers along the described line if the material permits. The unused portion of the stencil apparatus that is separated by the severing can be used again with other stencils without loss of function if the length permits. One can see here that the stencil apparatus has the unique advantage in that it can be cut or shortened as necessary according to the number of stencils needed in a particular application, providing a savings in materials and a reduction in wasted product. Additional spacers are not required to fill the remaining or unused space at the end of the apparatus as required in conventional stencil holders. This unique feature, furthermore, allows for the stencil apparatus to be provided in longer lengths or even for sections of the apparatus to be cut from a roll form as seen in FIG. 16. The individual stencils attach to the stencil apparatus with sufficient adhesive strength so that they provide additional structural support to the apparatus. This added structural support now allows the bottom liner 20 to be separated, removed, or stripped away in whole or in part without significant loss of structural rigidity to the stencil attachment members 40 with their attached stencils. Separations or transverse die cuts 26 are provided in this embodiment and extend across and through the bottom release liner 20, as shown in FIGS. 1, 4, 5A, 5B, and 7. These transverse die cuts facilitate the above-mentioned removal of the bottom sheet. These die cuts may also be provided to extend longitudinally along the length of the assembly.

Figure 7:
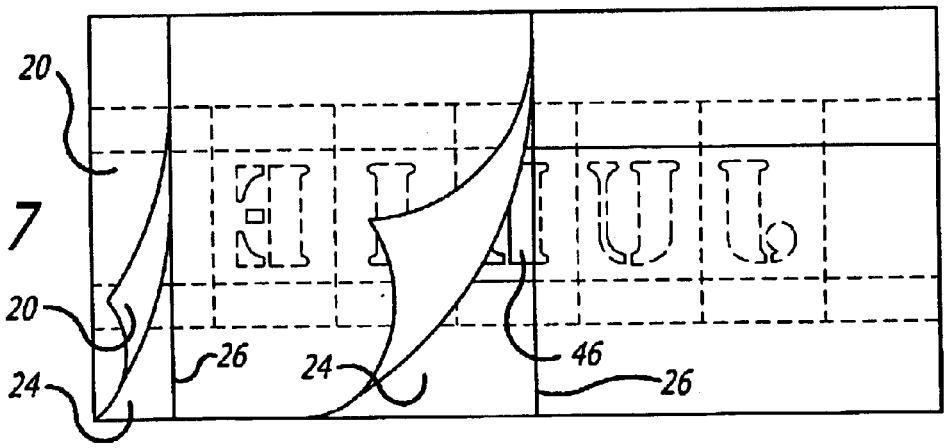
FIG. 7. is a rear fragmentary view of the stencil apparatus illustrated in FIG. 6. but with the end completely cut and the bottom liner partially peeled away at the transverse die cuts.

Using one's fingers, the stencil apparatus is simply bent on its rear side along each of the transverse die cuts and the release liner is removed or stripped away and discarded. FIG. 7 shows the rear view of the stencil apparatus where the bottom liner is partially removed in this manner and where the stencil openings or central cut outs 46 are partially exposed. FIG. 8 illustrates the stencil apparatus with the assembled stencils ready to be applied to a surface with the back liner completely removed and the stencil openings exposed. The stencil apparatus and assembled stencils can now be applied to a surface by gentle finger or hand pressure applied to their surface. In practice, it has been found that movement, replacement and repositioning of the stencil apparatus for purpose of centering and alignment can be achieved more easily if the stencil apparatus is first lightly attached to the intended surface. This can be accomplished by lightly tacking one or both ends of the apparatus to the surface and then evaluating the placement before applying final heavier finger pressure to the apparatus and stencils. Once satisfied with the placement of the apparatus, the panels 38, which were removed earlier and shown set aside in FIG. 4, can be cut, torn or otherwise severed to approximate the length of the assembled stencils and apparatus. The shortened panels can now be used as additional masking. The panels can be placed horizontally to overlap an edge of the apparatus and a portion of the masking section 36 as shown in FIG. 9A. Any remnants of the masking section can be used for additional masking at this point or saved and used for another stenciling application.

With the stencil apparatus adhesively secured to a surface and the panels placed for masking, a surface 78 can be marked through the central cut outs 46 of the individual stencils as shown in FIG. 9B. The marks can be made with solutions such as inks, paints, or dyes as well as with chemical etchants. They can even be made with abrasion or sandblasting technology. Any appropriate applicator known to those skilled in the art can be used to apply the marking medium. Once marked, the stencil apparatus and the attached stencils can be very easily peeled off the surface leaving the stenciled markings, as shown in sequence in FIG. 10A and FIG. 10B. The time the stencils are left intact on the surface is usually determined by the characteristics of the surface intended to be marked and the marking medium used. Sometimes liquid marking mediums such as inks or paints are allowed to dry first prior to stencil removal to give sharp edge detail and to avoid smearing. However, it has been found that removing the stencil apparatus and stencils while the ink or paints are still wet will sometimes give better results.

Some selected surfaces to be marked can be highly attracted to the adhesive chosen for the individual stencils and/or the stencil apparatus. This increased attraction is usually due to the use of a high tack or aggressive adhesive on the stencils and stencil apparatus in combination with a target substrate, which has a relative high surface energy. Generally, the higher the surface energy of the target surface the greater the molecular attraction it has to the selected adhesive. This increased attraction can make it more difficult to move, rearrange, or replace the stencil apparatus with the attached stencils should the stencil alignment not be accurate upon first placement. In such described cases repositioning of the apparatus can be accomplished by first removing only a portion or section of the bottom release liner. In FIG. 7, for example, the bottom release liner is divided into three sections by the transverse cuts 26. In this example one of the end portions of the bottom sheet could first be removed while leaving the other two sections in place. This would then allow the apparatus to be placed on a surface with a smaller amount of exposed adhesive contacting the surface. Such reduced adhesive exposure would allow removal and repositioning of the apparatus more easily. When one is satisfied with the proper position of the stencil apparatus, the non-adhesive portion can be lifted up or folded back on itself slightly and the remaining portion of the release liner removed so that the rest of the apparatus can be laid down.

In some applications where even higher tack pressure sensitive adhesives are required on the stencils and/or the apparatus, and where high energy surfaces are targeted to be marked using these adhesives, it presents more of a problem for repositioning of the stencils and apparatus after initial contact, as one can appreciate. Fortunately this problem can be addressed by the novel construction of the apparatus. It has already been demonstrated how selected areas of the bottom sheet or release liner can be removed to expose the underlying pressure sensitive adhesive. The adhesive area exposed can be made to be quite small where conditions, as described above, warrant.

Figure 11B:
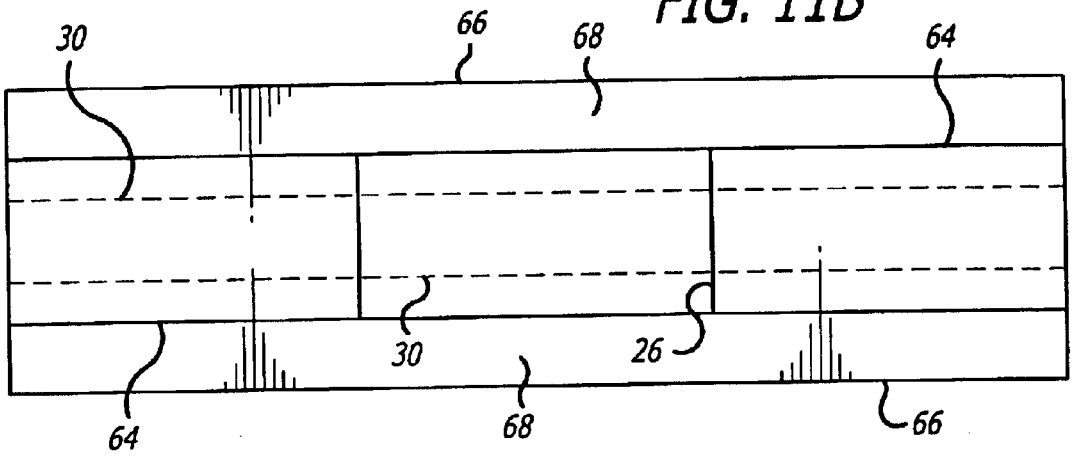
FIG. 11B. is similar to FIG. 11A but showing an additional elongated strip in the lower part of the apparatus.

In FIG. 11A and FIG. 11B are plan views of variations of the rear aspect of the stencil apparatus are illustrated. In these views are shown the previously described transverse die cuts 26 as well as the longitudinal die cuts 30 located on the front side of the apparatus and depicted here in dashed lines. In addition, one or more separations or back die cuts 64 can be seen in these figures. FIG. 11A shows a back die cut 64, which is made through the release liner 20. It extends horizontally across the length of the apparatus intermediate the longitudinal die cuts 30 on the front side, shown in broken lines, and the extreme upper horizontal edge of the apparatus or the outside edge of the masking section 36. This back die cut forms an elongated strip 68 which lies between this described back cut and the upper horizontal edge of the stencil apparatus. FIG. 11B shows a back die cut and elongated strip similar to the one located in the upper aspect of FIG. 11A but with an additional back cut and strip also located in the lower part of the apparatus.

Figure 11C:
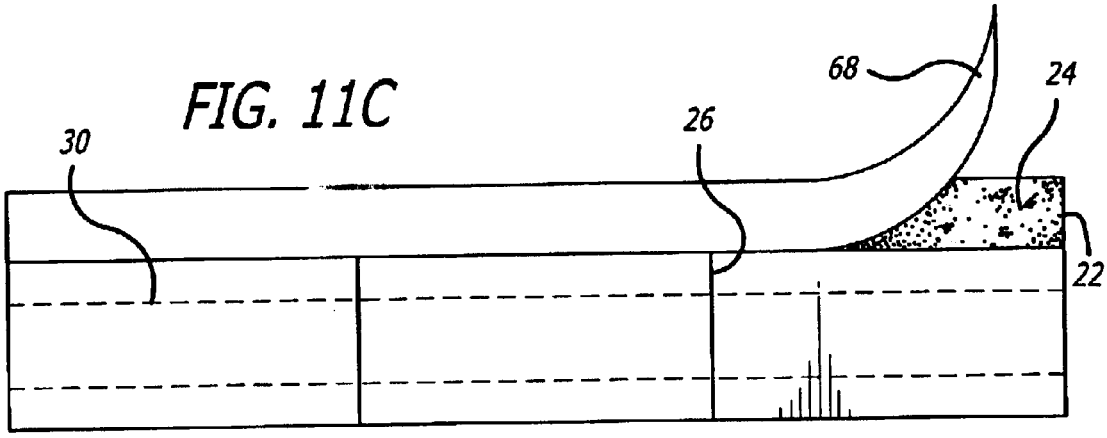
FIG. 11C. shows how the elongated strip is removed from the apparatus thereby exposing a portion of the underlying adhesive for temporary placement of the apparatus with its attached stencils.

The elongated strips 68, in either of the above examples, can be removed easily by bending along a horizontal back cut near the end of the apparatus and peeling the entire strip up and off as shown in FIG. 11C. This operation exposes a thin strip of the pressure sensitive adhesive 24 on the underside portion of the overlying top sheet 22. The area of pressure sensitive adhesive exposed corresponds substantially to the underside of the masking section 36 also located on the front side of the apparatus. Exposing such a small amount of adhesive at a time either by removing a top or bottom elongated strip 68 or both enables the entire stencil apparatus with the attached stencils to be initially lightly tacked in place on a surface. Such initial placement allows for preview of alignment and positioning of the stencil apparatus prior to a more complete removal of the bottom liner.

Once satisfied with the placement of the stencil apparatus one end of the apparatus can be lifted up and partially folded back on itself so one section at a time of the release liner 22 can be removed at the transverse die cuts 26 as described earlier. In this manner a portion of the stencils and their central cutouts, together with the apparatus can sequentially make contact with the target surface without having to lift up or remove the entire stencil apparatus from the surface.

Figure 12:
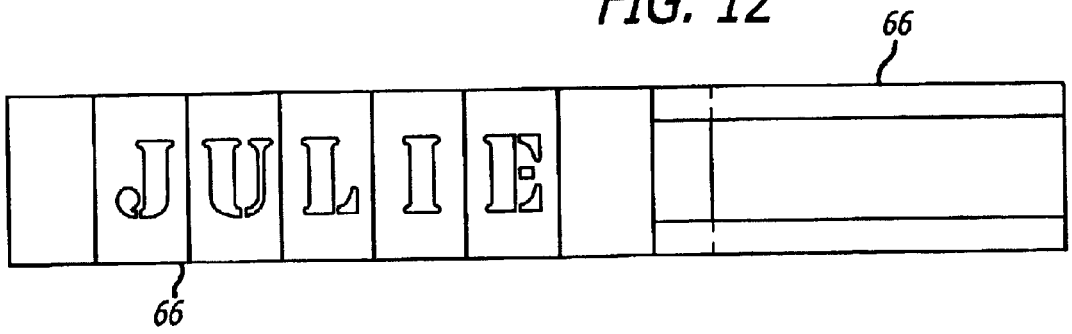
FIG. 12. shows a stencil apparatus similar to FIG. 1. but where the upper and lower edges of the apparatus are used to align the individual stencils.

Additional embodiments are illustrated in FIGS. 12, 13A, 13B, 14, 15, 16, and 17. The panels 38 are not shown but removed in FIGS. 12, 13A, and 13B. FIG. 12 is a view of one of these designs similar in all aspects to the typical embodiment of FIG. 1 except where the alignment lines 34 have been omitted. The upper and lower outside edges 66 of the stencil apparatus are used in this example as alignment means to align the stencils as shown. Variations on this example are easily made and could include some combination of this apparatus and the typical embodiment mentioned above or some combination of another ramification. For example, an apparatus could be constructed where only one alignment line or one outside edge is used for alignment or some combination of both.

Figure 13A:
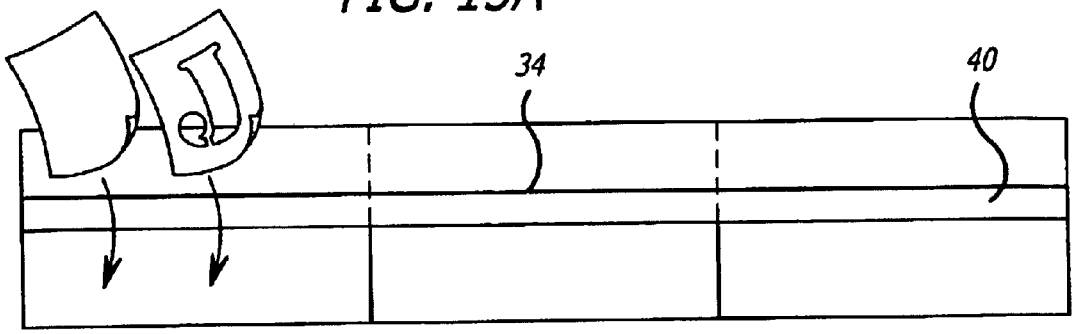
FIG. 13A is a view similar to FIG. 1. but using only a single attachment member.
Figure 13B:
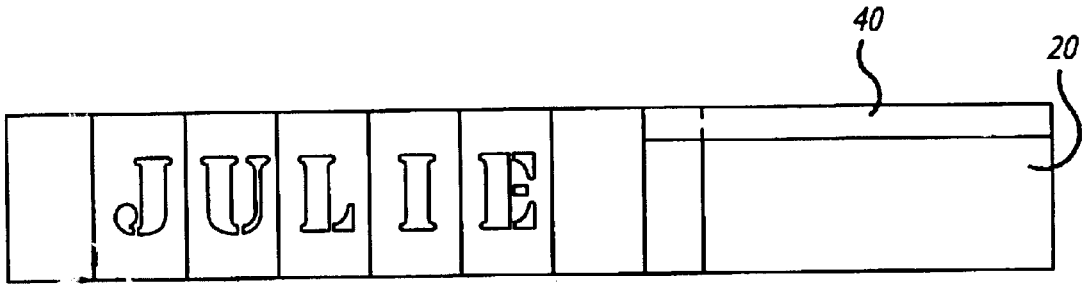
FIG. 13B is a view similar to FIG. 12. except a single stencil attachment member is employed.

FIG. 13A is a view similar to FIG. 1 in all respects but showing how simply the apparatus can be formed by using only a single stencil attachment member 40. In this example, the stencils would be attached to the apparatus as shown earlier and placed with the aid of a single alignment line 34 as shown in this example. The stencils also could be aligned with the upper and/or lower edge of the apparatus as shown in FIG. 13B which is similar to FIG. 13A but where the alignment line has been omitted. The stencils used on these variations can be identical to those shown earlier or they can be modified somewhat with the extended area 54 reduced in size. The single attachment member 40 of the apparatus is shown in FIGS. 13A and 13B preferably in the upper aspect of the apparatus, however, it could also function in the lower position. All the variations possible in the first example are also applicable here as well as combinations and variations from the other ramifications.

Figure 14:
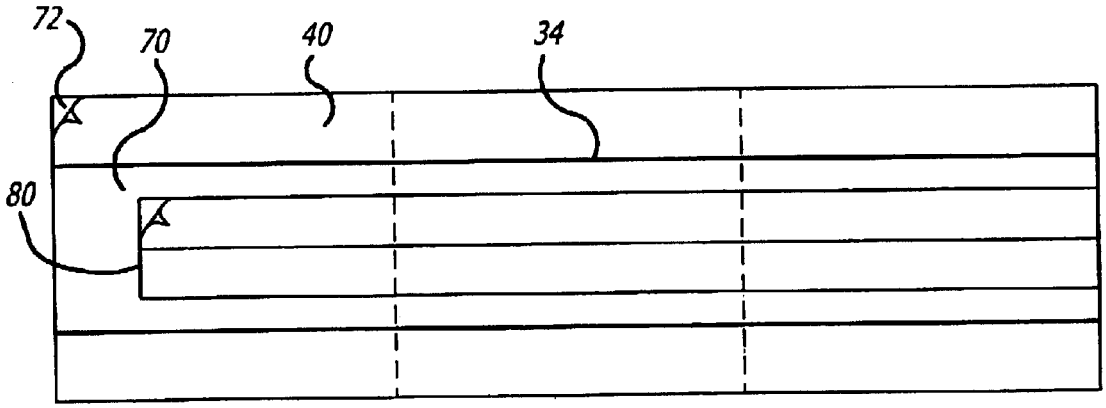
FIG. 14. is a view of yet another design of the invention with one end of the apparatus closed.

FIG. 14 is a view of another design or embodiment of the invention showing how in the unique construction of the apparatus one end 70 can be left closed as shown. The closed end 70 in this example is continuous with the stencil attachment member 40. An additional perpendicular end cut 80 is formed in the top sheet between the two longitudinal die cuts to allow for removal of the panels. The advantage of this design is in having the closed end 70 providing some built-in masking means by serving as a spacer. The initial stencil placement would simply overlap slightly the closed end and the adjacent panel where they meet at the end cut 80. In addition, the stencil apparatus with attached stencils can be optionally separated from the back liner by bending and lifting the entire unit up by additional top die cuts 72 which extend through the top sheet to the bottom liner. Alternatively, both ends of the apparatus can be made closed and spacers can be used to fill any remaining spaces at the end. Variations on this design can include one or more elements from the preferred example or from the other embodiments. Stencils, for example, can be placed by using only one alignment line or one or more edges of the apparatus instead of alignment lines.

FIG. 15 is a view of another design of the invention showing a series of openings 74 provided for accepting individual adhesive stencils. In this example separate or individual panels 38 are formed by cuts 72 and removed, thereby exposing the bottom liner. Alternatively, the individual panels 38 can be removed in the manufacturing process so they don't have to be removed by hand. An additional support area 76 intermediate the stencil openings and continuous with the stencil attachment member 40 is formed from the top sheet and provides additional stability and support for the stencils. This application of the invention is ideally suitable for stencils representing numerical indicia where visual letter alignment type spacing is not critical but where extra structural support is important. The stencils can be aligned with the aid of one or more structural edges or with one or more alignment lines on the surface of the apparatus as described with the previous ramifications. If alignment lines are used with this form of the invention then some built-in masking would be available in this structure similar to other examples shown earlier. Likewise, the lines can be separated in whole or in part to expose the bottom adhesive in a variety of ways as shown in the prior ramifications.

FIG. 16 is a view of still another embodiment of the invention where the apparatus is shown in a continuous strip or roll form, similar to a roll of tape. This embodiment takes advantage of the flexibility of the apparatus and its novel ability to be cut, or otherwise severed to any suitable length and still be functional. The apparatus as shown here rolled up upon itself can accommodate an extended length in a compact form. Longer amounts of the stencil apparatus can thereby be stored easily and conveniently dispensed and then cut to the needed size. Although this version is shown combined with a specific embodiment, any suitable ramification or combination can be provided in this form as well.

FIG. 17 is a plan view of yet another design of the stencil apparatus formed as part of a larger sheet. In this example the stencil apparatus is formed or die cut preferably along with the individual stencils from a sheet of material similar to the sheet shown and discussed earlier in FIG. 3. The stencils would be placed according to the previous examples. Once the stencils are placed on the apparatus, the entire assembly can be peeled or separated from the larger sheet. Bending the apparatus along the die cut forming its top left boundary can facilitate this process. All of the materials used to form both the sheet and stencils in this ramification have the properties, which conform to the requirements of the stencil apparatus discussed earlier. The individual stencils and the stencil apparatus therefore share the same sheeting materials, pressure sensitive adhesive, release liner, etc. There are again various possibilities with regards to the stencil apparatus form or variation one chooses to use in this manner. Although the example shown previously in FIG. 14 was chosen to be combined or made in this way, the apparatus can resemble one of the forms or ramifications listed above or any combination thereof. There are also various placement, positioning or arrangement choices one has as to the particular location of the chosen stencil apparatus as well as the stencils on the sheet. The combination of stencils and stencil apparatus formed together as shown in FIG. 17 from a single sheet of common materials, could prove to be a manufacturing, handling and or packaging advantage.

Another embodiment of the apparatus of the present invention is illustrated in FIGS. 18, 19, 20, and 21. In FIG. 18 a view shows the apparatus again as generally elongated in shape but constructed from only a single sheet of flexible planar material 18. The simplicity of construction could prove to be an economic as well as a structural advantage with certain applications. The material used for the sheeting can also come from a variety of substrates including paper, films, foils, etc. as previously discussed. The material should have an additional property of being able to tear easily along perforations. The planar sheeting should, preferably, also have release characteristics 28 on the upper or exposed surface. Longitudinal die cuts, perforations 16 or other severance means are made in or through the planar sheeting and run parallel to each other and along the length of the apparatus. These perforations form the removable panels 38 in the planar sheeting. The removable panels are designed to be of sufficient width and height to accept the central cutout 46 portion of the individual stencils 42, as in previous examples. The longitudinal perforations or severance means 16 also define the boundary of the stencil holder or stencil attachment members 40. Two separate stencil placement guide lines or alignment lines 34 are again located on either side of the surface of the apparatus and bisect both of the stencil attachment members 40 along their length. The area between the alignment lines 34 and the outside edges of the stencil apparatus serves as an additional and optional masking section 36, as described in previous examples. One or more separations or transverse die cuts 26 extend through the planar sheeting 18 between the lateral perforations. The transverse die cuts provide means for easily stripping away the removable panels 38 after the stencils have been attached. These transverse die cuts facilitate the above mentioned removal of the removable panels by providing a convenient finger hold where one can tear the removable panels along the longitudinal perforations.

Figure 19:
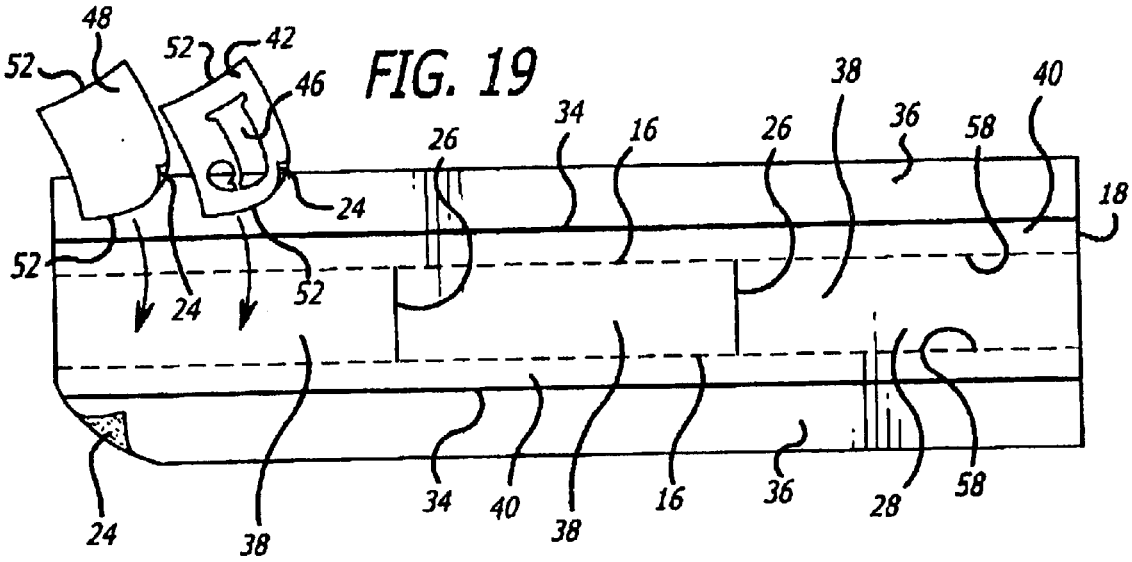
FIG. 19. Illustrates a similar view of the stencil apparatus in FIG. 18. showing an adhesive stencil blank and stencil about to be placed on the apparatus.
Figure 20:
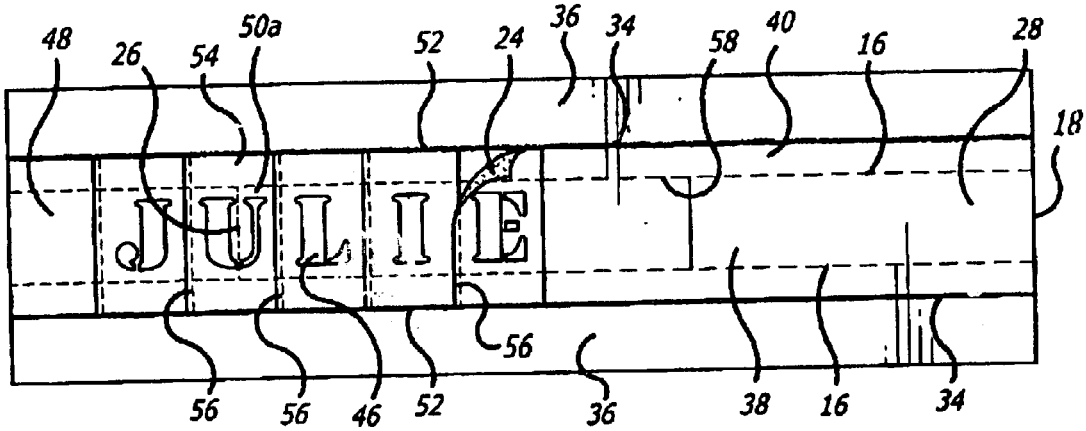
FIG. 20. is a view similar to FIG. 19. showing the stencil blank and stencil in place along with additional stencils placed onto the assembly.

FIG. 19 shows a stencil blank or spacer 48 and a stencil 42 about to be placed on the apparatus. FIG. 20 shows some stencils placed on the apparatus. The apparatus can be cut with a scissors after the last stencil or blank has been applied, like previous examples.

Using one's fingers, the stencil apparatus is simply turned over on its rear side and a section of the removable panel is grasped with one's fingers along one of the transverse die cuts. The end of the removable panel is lifted up and striped away along the lateral perforations. In the same manner, the remaining panels can be removed.

Figure 21:
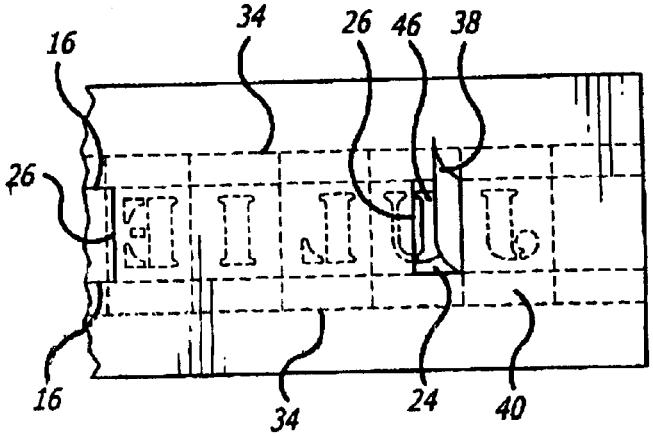
FIG. 21. is a rear view of a portion of the stencil apparatus illustrated in FIG. 20. but with a stencil exposing panel partially peeled away at a transverse die cut.

FIG. 21 shows the rear view of the stencil apparatus, with stencils attached, where removable panel 38 is partially removed at a transverse die cut in the above-described manner and where a stencil opening or central cut out 46 and the stencil's adhesive 24 is partially exposed. Once the remaining panels 38 are removed, the apparatus can be applied to a surface. The apparatus attaches to the surface by means of the adhesive exposed on the backside of the stencils.

A material found suitable for this embodiment or application is supplied by Pepperell Paper Company Inc., a subsidiary of Merrimac Paper Company, Inc. of Pepperell, Mass. It is described as a white 50 lb. Stryban® paper, and is water and grease resistant. Although this paper is believed to be manufactured for the food packaging industry, it demonstrates properties which make it a suitable choice for use in this ramification. It allows the adhesive stencils to adhere to its surface while also allowing for their removal. In addition, the paper is easily and cleanly separated along the perforation lines.

The stencils and adhesive used on the stencils are identical to the Tyvek® material and adhesive that were used and described in the prior examples. Tyvek®, however, is not recommended as a suitable sheeting material for use as the planar material 18 in this last embodiment under consideration since it is tear resistant.

The above-described embodiment, like the preferred embodiment in FIG. 1. can also be formed or configured in a variety of ways, as will be apparent to one skilled in the art. If one skilled in the art chooses, this single-sheet embodiment can, with some modifications, be adapted to conform to any of the forms or designs or combinations of forms or designs shown in FIG. 12 through FIG. 17. For example, variations can be made in this embodiment as to: whether the stencils are to be aligned using alignment lines or the apparatus's upper and lower edges; the use of an upper and/or lower stencil attachment member; whether the apparatus will have one or two closed ends; whether a series of individual panels will be formed in the apparatus (made removable by lines of weakness; forming the apparatus into a roll form to resemble a tape. Since it Is considered evident what these designs would generally resemble, it is thought to be redundant to reproduce them here. They have been omitted for sake of brevity.

In addition, this form of the invention or any other ramification can even be coated on its backside with a pressure sensitive adhesive if so desired. The stenciling apparatus so coated would resemble an adhesive tape with all the benefits known to those skilled in the art.

Summary, Ramifications, and Scope

Accordingly, the reader will see that the stencil apparatus of this invention will enable a person with no prior experience to be able to easily and accurately place adhesive stencils and mark a surface with professional results. The reader will further see that this is accomplished through the application of adhesive stencils with the aid of a very versatile stencil apparatus. The disclosed apparatus allows the user to easily and accurately align, position, and reposition the stencils on the apparatus as well as the target surface. This allows users to easily correct stenciling placement errors at critical steps in the process. The novel features of the invention made possible by its unique construction impart a user-friendly nature to the apparatus not available with other stenciling means. The stencil apparatus has the additional following advantages:

- it provides a quick, inexpensive, and rapid way for adhesive stencils to be easily applied to a surface and masked so said surface can be marked.
- it allows individual stencils, coated with high tack adhesives, to be placed on the apparatus and then easily removed as often as necessary so that errors in stencil placement and alignment can be corrected.
- it provides options that enables portions of the apparatus, with its stencils attached, to be first lightly and adhesively adhered to a surface so that the position and placement of the apparatus can be visually checked. This feature allows the stencils and apparatus to be moved easily around on highly attractive surfaces thereby facilitating centering and the avoidance of surface features such as stitching, existing lettering, etc.
- it can be provided in a kit form together with suitable inks, paints, dyes, etc. along with applicators so specific objects can be marked.
- it provides for masking in a novel way through the use of excess top sheeting material that otherwise would be wasted.
- because of the common nature of the materials used in the apparatus, it can be easily made using existing manufacturing technology.
- because of the wide range of materials available for manufacturing, the stencil apparatus can be made to be disposable or the apparatus and attached stencils can be made to be re-usable by various means; such as cleaning or washing and then drying the apparatus and attached stencils.
- due to its unique construction, the apparatus can be cut to any desired length without loss of functionality thereby eliminating the need for additional spacers or. Any unused or cut portion of the apparatus can also be used, when convenient, providing additional savings in materials.
- it can be uniquely tailored to meet the adhesive requirements of the stencils and the target surface.
- it has practical applications not only for personal use but also for use in industrial, military, government, institutional, or business settings where a simple identification system is needed.
- it provides a flexibility that allows the apparatus to bend and conform to the shape of various objects.

It has been shown and exemplified by the various ramifications how the novel structure of the invention allows it to be manufactured in a wide variety of ways and forms. In addition, it should be understood that the invention can be formed from variations as well as combinations of these ramifications. For example, it should be readily apparent that elongated rows of alphabetical or numerical characters, other than straight rows presented here, such as angled, spiraled, arched, or the like can also be accomplished with the principles of this invention, with the described features extending longitudinally along the length of the stencil apparatus. Also, the stencils of this invention could be constructed with adhesive covering only the area intended for contact with the stencil apparatus' stencil attachment member. This would limit adhesive contact with highly fragile surfaces, such as paper, allowing the apparatus to be easily repositioned so that indicia could be traced, etc., as well as the amount of required adhesive. Furthermore, although specific examples of application have been suggested for use with this invention it should not be considered limited to these specific applications but of general use anywhere where adhesive stencils need to be accurately applied, including silkscreen processes.

With regard to the other alternatives, reference is made to the embodiment of the invention shown in FIGS. 1 and 2 of the drawings. In the showing of FIG. 1, the panels 38 were die cut along severance lines 30. However, instead of forming the assembly initially with the central panel or panels 38 present, the stencil assembly of FIG. 1 could be formed without the central panel or panels 38, by just assembling the stencil structure with the two outer, upper and lower stencil attachment members 40 present. The severance lines 30 would still be present, but would involve the cutting or severing of the upper and lower stencil attachment members from other stock material. Concerning the construction of FIG. 19, the lower surface of the single sheet may be coated with pressure sensitive adhesive 24 as indicated at the lower left corner of FIG. 19. However, in some cases, the lower surface may be free of adhesive, and rely on other arrangements, including the adhesive on the stencil elements, to mount the stencil assembly. It is also noted that, when the stencil sheet of FIG. 19 has pressure sensitive adhesive on its lower surface, the stencil sheet may be mounted on a release sheet or strip; or wound up upon itself like an adhesive tape.

In addition, the stencil apparatus could be included in a kit, with stencil elements, the stencil base structure, marking material such as ink or paint, for examples, and an applicator, all included in the kit.

The above description which contains many specifics, which explain and illustrate the invention, and the invention is not limited thereto as those skilled in the art who have the disclosure before them will be able to make modifications and variations therein without departing from the spirit and scope of the invention. Accordingly, the present invention is not limited to the specific illustrative embodiments shown in the drawings and described in detail hereinabove.

What is claimed is:

1. A stenciling method comprising the steps of:

forming a two-layer stencil apparatus including an upper adhesive coated sheet and a lower release liner, cutting a longitudinal strip along at least one severance line through said upper layer, removing said strip, mounting adhesive coated stencil elements to extend across the space remaining from the removal of said strip, removing at least a portion of said release liner from said apparatus, mounting the remainder of said apparatus on the surface to be stenciled, with the adhesive on said upper sheet and said stencil elements holding said apparatus in place, and applying marking material onto said surface through openings made in said stencil apparatus by said removing of at least a portion of said release liner therefrom.

2. A stencil apparatus comprising;

a. an elongated stencil support sheet having located between opposed peripheral edges thereof an elongated access area for registration therewith cutouts made through stencil plates positionable in parallel overlying relationship to said stencil support sheet, said stencil support sheet having at least a first elongated stencil plate support area located between at least one of said opposed peripheral edges of said stencil support sheet and said access area thereof, b. means for mounting to said stencil plate support area of said stencil support sheet a first peripheral region of a lower side of each a plurality of individual stencil plates having therethrough indicia cutouts in the shape of desired indicia, said peripheral region of each said stencil plates being located between said cutout and a peripheral edge of said stencil plate, said cutouts of said stencil plates overlying said access area of said stencil support sheet, c. means for forming openings through at least portions of said access area of said stencil support sheet which are to underlie said cutouts of said stencil plates to thereby provide unobstructed access to said cutouts, and d. means for mounting said stencil support sheet and said stencil plates mounted thereto to an object surface whereby paint, ink, or other appropriate marking material may be applied through said stencil plate cutouts and said openings made through said access area of said stencil support sheet, to thereby imprint images of said stencil plate cutouts onto said object surface.

3. The apparatus of claim 2 wherein said means for forming openings through said access area of said stencil support sheet includes at least a first severance line which at least partially penetrates said access area, whereby at least a portion of said access area is severable and retractable away from a plane of said stencil support sheet.

4. The apparatus of claim 3 wherein said first severance line defines at least a portion of a perimeter of a said opening.

5. The apparatus of claim 2 wherein said means for mounting a first peripheral region of a lower side of a stencil plate to said first stencil plate support area of said stencil supporting sheet is further defined as being a pressure-sensitive adhesive layer on at least one of a lower surface of stencil plate and an upper surface of said stencil support area of said stencil support sheet.

6. The apparatus of claim 2 further including at least a second stencil support area located between a second peripheral edge of said stencil support sheet and said access area thereof, and means for mounting a second peripheral region of a lower side of said stencil plates to said second stencil support area.

7. The apparatus of claim 6 wherein said means for mounting said first and second lower peripheral regions of said stencil plate to said first and second stencil support areas of said stencil support sheet is further defined as being a pressure-sensitive adhesive layer on at least one of a lower surface of said stencil and an upper surface of said stencil plate support areas.

8. The apparatus of claim 7 wherein said means for forming openings through said access area of said stencil support sheet includes at least a first severance line which at least partially penetrates said access area, whereby at least a portion of said access area is severable and retractable away from a plane of said stencil support sheet.

9. The apparatus of claim 8 further including a second severance line spaced apart from said first severance line, whereby said first and second peripheral lower surface areas of at least one of said stencil plates are mountable to said first and second stencil plate support areas, respectively, of said stencil support sheet, with said cutouts of said stencil plate overlying said access area of said stencil support sheet, and whereby at least a portion of said access area may be severed from-said stencil support sheet along said first and second severance lines, said first and second stencil plate support areas of said stencil support sheet being held in fixed relationship to said stencil plates by said mounting means joining said stencil plate to said first and second stencil plate support areas of said stencil support sheet.

10. The apparatus of claim 9 wherein said first and second severance lines are further defined as being disposed longitudinally to said stencil support area of said stencil support sheet.

11. The apparatus of claim 2 wherein said means for mounting said stencil support sheet to an object surface is further defined as a pressure-sensitive adhesive located between said object surface, and at least one of a lower surface of said stencil support sheet and a lower surface of said stencil plate.

12. The apparatus of claim 2 wherein said stencil support sheet is further defined as having a laminated construction which includes:

a. a top sheet, b. a pressure sensitive adhesive layer adhered relatively strongly to a lower surface of said top sheet, and c. a bottom release liner sheet having an upper surface adhered relatively weakly to said adhesive layer.

13. The apparatus of claim 12 wherein said access area of said stencil support sheet is further defined as being a portion of said stencil support sheet comprising a portion of said bottom release liner sheet which is not overlain by said adhesive layer and said top sheet.

14. The apparatus of claim 13 wherein said means for forming openings through said access area of said stencil support sheet includes means for removing at least an area portion of said bottom release liner of said stencil support sheet.

15. The apparatus of claim 12 wherein said access area of said stencil support sheet is further defined as being a portion of said stencil support sheet formed by removal of a panel portion of said top sheet and adhesive layer adhered thereto from said bottom release liner sheet.

16. The apparatus of claim 15 wherein said top sheet and adhesive layer of said stencil support sheet have cut at least partially therethrough at least one longitudinally disposed severance line enabling said panel portion of said top sheet and adhesive layer to be stripped away from said bottom release liner sheet.

17. The apparatus of claim 16 wherein said means for forming openings through said access area of said stencil support sheet includes means for removing at least an area portion of said bottom release liner sheet of said stencil support sheet.

18. The apparatus of claim 12 wherein said means for mounting said stencil support sheet onto a object surface is further defined as comprising at least a first longitudinally disposed lower severance line which is spaced inwardly of a longitudinal edge of said stencil support sheet, said lower severance line at least partially penetrating said bottom release liner and thereby enabling a portion of said bottom release liner to be severed and retracted away from said stencil support sheet, thereby exposing said adhesive layer for adhesive attachment to said object surface.

19. The apparatus of claim 12 further including a stencil plate sheet comprising a plurality of individual stencil plates severable from said stencil plate sheet.

20. The apparatus of claim 19 wherein said stencil plate sheet is further defined as having a laminated construction which includes:

a. a top sheet, b. a pressure-sensitive adhesive layer adhered relatively strongly to a lower surface of said top sheet, and c. a bottom release liner sheet having an upper surface adhered relatively weakly to said adhesive layer.

21. The apparatus of claim 20 wherein said top sheet, pressure-sensitive adhesive layer, and bottom release liner of said stencil plate sheet are each contiguous with said top sheet, pressure sensitive adhesive layer and bottom release liner, respectively, of said stencil support sheet.

22. The apparatus of claim 2 wherein said stencil support sheet is further defined as comprising a single sheet of planar material.

23. The apparatus of claim 22 wherein said means for forming openings through said access area of said stencil support sheet is further defined as including at least a first severance line which at least partially penetrates said access area and defines at least a portion of a perimeter of a said opening.

24. The apparatus of claim 22 wherein said means for forming openings through said access area of said stencil support sheet is further defined as comprising in combination at least one pair of spaced apart, longitudinally disposed severance lines and one pair of transversely disposed severance lines, each of which severance lines at least partially penetrates said access area.

25. The apparatus of claim 24 wherein said means for mounting said stencil support sheet to an object surface is further defined as including a pressure-sensitive adhesive on at least a portion of said peripheral region of a lower side of said stencil plate.

26. The apparatus of claim 2 further including at least a first guide line on an upper surface of said stencil support sheet, for aligning edges of said stencil plates on said stencil support sheet.

27. The apparatus of claim 2 wherein said stencil support sheet, said stencil plates, and said marking material are combined in a kit.

28. A stenciling method comprising the steps of:

a. forming an elongated stencil support sheet having located between opposed peripheral edges thereof an elongated access area for registration therewith cutouts made through stencil plates positionable in parallel overlying relationship to said stencil support sheet, said stencil support sheet having at least a first elongated stencil plate support area located between at least one of said opposed peripheral edges of said stencil support sheet and said access area thereof, b. mounting to said stencil plate support area of said stencil support sheet a first peripheral region of a lower side of each a plurality of individual stencil plates having therethrough indicia cutouts in the shape of desired indicia, said peripheral region of each said stencil plates being located between said cutout and a peripheral edge of said stencil plate, said cutouts of said stencil plates overlying said access area of said stencil support sheet, c. forming openings through at least portions of said access area of said stencil support sheet which are to underlie said cutouts of said stencil plates to thereby provide unobstructed access to said cutouts, d. mounting said stencil support sheet and said stencil plates mounted thereto to an object surface, and, e. applying paint, ink or other suitable marking material through said stencil plate cutouts and said openings made through said access area of said stencil support sheet, to thereby imprint images of said stencil plate cutouts onto said object surface.

29. The method of claim 28 wherein said step of forming an opening through said access area is further defined as being facilitated by at least a first severance line which at least partially penetrates said access area and defines at least a portion of a perimeter of a said opening.

30. The stenciling method of claim 28 wherein said stencil support sheet is further defined as having a laminated construction which includes:

a. a top sheet, b. a pressure sensitive adhesive layer adhered relatively strongly to a lower surface of said top sheet, and c. a bottom release liner sheet having an upper surface adhered relatively weakly to said adhesive layer.

31. The method of claim 30 wherein said access area of said stencil support sheet is further defined as being a portion of said stencil support sheet comprising a portion of said bottom release liner sheet which is not overlain by said adhesive layer and said top sheet.

32. The method of claim 31 wherein said step of forming openings through said access area of said stencil support sheet includes removing at least an area portion of said bottom release liner of said stencil support sheet.

33. The stenciling method of claim 30 wherein at least a portion of said access area of said stencil support sheet is further defined as being a portion of said stencil support sheet formed by removal of a panel portion of said top sheet and adhesive layer adhered thereto from said bottom release liner sheet.

34. The stenciling method of claim 33 wherein said top sheet and adhesive layer of said stencil support sheet have cut at least partially therethrough at least one longitudinally disposed severance line enabling said panel portion of said top sheet and adhesive layer to be stripped away from said bottom release liner sheet.

35. The stenciling method of claim 34 wherein said step of forming openings through at least portions of said access area of said stencil support sheet is further defined as including removing at least a portion of said bottom release liner from said stencil support sheet.

36. The method of claim 35 wherein said step of removing at least a portion of said bottom release liner to form a said opening therethrough is further defined as being facilitated by at least a first severance line which at least partially penetrates said access area and defines at least a portion of a perimeter of said opening.

37. The stenciling method of claim 30 wherein said step of mounting said stencil support sheet to an object surface is further defined as being facilitated by provision of at least a first severance line which at least partially penetrates said bottom release liner and thereby enables a portion of said bottom release liner to be severed and retracted away from said stencil support sheet, thereby exposing said adhesive layer for adhesive attachment to said object surface.

38. The stenciling method of claim 28 wherein said stencil support sheet is further defined as as comprising a single sheet of planar material.

39. The stenciling method of claim 38 wherein said step for forming openings through at least portions of said access area of said stencil support sheet is further defined as being facilitated by providing at least a first severance line which at least partially penetrates said access area.

40. The method of claim 39 wherein said first severance line defines at least a portion of a perimeter of a said opening.

41. The stenciling method of claim 38 wherein said step of mounting said stencil support sheet to an object surface is further defined as being facilitated by providing a pressure-sensitive adhesive on at least a portion of said peripheral region of a lower side of said stencil plate.

* * * * *